US006749281B2

(12) United States Patent
Asauchi

(10) Patent No.: US 6,749,281 B2
(45) Date of Patent: Jun. 15, 2004

(54) SYSTEM AND METHOD OF IDENTIFYING PRINTER RECORDING MATERIAL RECEPTACLE

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/170,404

(22) Filed: Jun. 14, 2002

(65) Prior Publication Data

US 2002/0191041 A1 Dec. 19, 2002

(30) Foreign Application Priority Data

Jun. 19, 2001 (JP) ..... 2001-184313

(51) Int. Cl.[7] ..... B41J 29/393; B41J 29/38

(52) U.S. Cl. ..... 347/19; 347/14

(58) Field of Search ..... 347/19, 14, 12, 347/10, 11, 23, 5, 20, 59, 60, 57; 358/504, 406; 400/55, 56

(56) References Cited

U.S. PATENT DOCUMENTS 6,151,041 A 11/2000 Bolash et al.

6,161,916 A 12/2000 Gibson et al.

FOREIGN PATENT DOCUMENTS

| | | |
|---|---|---|
| EP | 0 765 762 A1 | 4/1997 |
| EP | 0 780 235 A2 | 6/1997 |
| EP | 1 004 447 A2 | 5/2000 |
| EP | 1 136 268 A1 | 9/2001 |
| JP | 2002-14870 | 1/2002 |
| WO | WO 98/52762 A2 | 11/1998 |
| WO | WO 01/25017 A1 | 4/2001 |

*Primary Examiner*—Raquel Yvette Gordon
*Assistant Examiner*—Charles Stewart, Jr.
(74) *Attorney, Agent, or Firm*—Sughrue Mion, PLLC

(57) ABSTRACT

A control circuit 30 that controls writing of data to storage devices 21–28 and reading of data from storage devices 21–28 transmits a clock signal SCK and a reset signal RST to storage devices 21–28 via a clock signal line CL and a reset signal line RL. Of the data transmitted by control circuit 30, first data SDA1, a data sequence intended for the storage devices 21, 23, 25, 27 of the first group, is supplied via a first data signal line DL1 to the storage devices 21, 23, 25, 27 of the first group. Second data SDA2, a data sequence intended for the storage devices 22, 24, 26, 28 of the second group, is supplied via a second data signal line DL2 to the storage devices 22, 24, 26, 28 of the second group.

23 Claims, 14 Drawing Sheets

SYSTEM AND METHOD OF IDENTIFYING PRINTER RECORDING MATERIAL RECEPTACLE

BACKGROUND OF THE INVENTION

1. Field of the Invention

The present invention relates to storage devices connected together by a bus, and more particularly to a technique for identifying a particular memory device from among a multiplicity of storage devices connected by a bus.

2. Description of the Related Art

Techniques by which a particular memory device may be selected from among a multiplicity of memory (storage) devices included in a memory module, so that data may be read therefrom or written thereto, include a technique used with a multiplicity of storage devices having bus connections to data signal lines and clock signal lines, wherein pre-established pull-up resistance or the like is utilized to assign, on the hardware level, identifying information to storage devices, so that this identifying information can be used to access a particular desired storage device. A problem with this technique, however, is that in practical terms it is not possible to rewrite the identifying information for storage devices once preset, making them unsuitable for recycled use.

Accordingly there has also been proposed a technique whereby identifying information on the software level is placed in some of the memory areas of a storage device. With this technique, identifying information stored in a storage device can be rewritten easily, which has the advantage of being suitable for recycled use.

However, a problem with this approach is that since identifying information takes the form of a data sequence stored in a memory area, as more storage devices are bus connected on a given data signal line, a larger data sequence is required, i.e., identifying information is composed of more data. This is a particular problem where a storage device assignable with identifying information has limited memory capacity. For example, where the storage device is a printer recording material receptacle (ink cartridge) used in a printing device, a greater number of items of identifying information (identifiers) will be needed for a greater number of colors of ink, whereas the use of a high-capacity storage device in such applications presents problems from a cost standpoint.

A still different technique uses, in addition to the data and clock signal lines, a chip select signal line that transmits a chip select signal to select a storage device. This has the advantage that identifying information need not be stored on individual storage devices, but requires providing chip select signal lines in a number corresponding to the number of storage devices, which creates the problem of an increasingly complicated wiring arrangement due to the greater number of signal lines. Another problem is that only one chip select signal line is used during access operations, so efficiency of signal line utilization is poor.

The present invention is directed to addressing the above problems and needs, and has as an object to increase the number of storage devices that can be identified, without increasing the data capacity needed to store identifying information. A further object is to reduce data write time of storage devices.

SUMMARY OF THE INVENTION

To solve the above problems, the invention in a first aspect thereof provides a system for identifying printer recording material receptacles, whereby, in a system comprising a multiplicity of printer recording material receptacles each having a sequentially accessible storage device, and individual selected printer recording material receptacle may be identified. The system for identifying printer recording material receptacles according to the first aspect herein comprises a multiplicity of printer recording material receptacle groups, each of which comprises a multiplicity of printer recording material receptacles; storage devices, provided to each said printer recording material receptacle, that store different identifying information within each said group; a multiplicity of data signal lines, said lines bus-connected on a group-by-group basis to the storage devices of the printer recording material receptacles that make up each said group; and information processing control means that utilizes said identifying information to select one or a multiplicity of desired printer recording material receptacles from among said printer recording material receptacles, and reads or writes information from or to the storage device of one or a multiplicity of selected printer recording material receptacles using one or a multiplicity of data signal lines selected from said multiplicity of data signal lines.

According to the storage control system pertaining to the first aspect of the invention, an individual data signal line is assigned to each group composed of a multiplicity of printer recording material receptacles. This allows the number of data signal lines to be kept to the minimum required, and since the identifying information need only contain enough information to identify each storage device within a group, it is possible to hold down the data capacity needed to store the identifying information, so that a greater number of printer recording material receptacles (storage devices) that can be identified. Further, since data can be transmitted individually via data signal lines to the storage devices of the printer recording material receptacles making up each group, simultaneous access (read and write) of the storage devices of each group is possible using the multiplicity of data signal lines, reducing the time needed to write to and read from the storage devices.

The invention in a second aspect thereof provides a system for identifying printer recording material receptacles that identifies a particular printer recording material receptacle from among a multiplicity of printer recording material receptacles comprising a multiplicity of sequentially accessible storage devices, wherein said system comprises: a multiplicity of printer recording material receptacles constituting a first class, each receptacle comprising a storage device that stores different identifying information; a single printer recording material receptacle constituting a second class, the receptacle comprising a storage device that stores identifying information identical to any identifying information stored in the storage devices constituting said first class, or identifying information different from all identifying information stored in the storage devices constituting said first class; a first data signal line, said line being bus-connected to the storage devices of the printer recording material receptacles constituting said first class; a second data signal line, said line being bus-connected to the storage devices of the printer recording material receptacles constituting said second class; and information processing control means that utilizes said identifying information to select on or a multiplicity of desired printer recording material receptacles from among said printer recording material receptacles, and reads or writes information from or to the storage device of one or a multiplicity of selected printer recording material receptacles using said first data signal line and/or said second data signal line.

According to the storage control system pertaining to the second aspect of the invention, the number of identifiable storage devices can be increased without the need for greater data capacity to store identifying information. The printer recording material receptacles making up the first class may contain the frequently used printer recording materials cyan, magenta, yellow and black, while the printer recording material receptacle making up the second class may contain a specialty color printer recording material used in particular applications, such as dark yellow or black. By so doing all printer recording material receptacles can be identified, even where a printer recording material receptacle containing a specialty color printer recording material is assigned arbitrary identifying information, such as the same identifying information for all specialty colors. Data read and write operations can be executed quickly using the first data signal line and second data signal line.

In a storage control system pertaining to the second aspect of the invention, the storage device of the printer recording material receptacle constituting the second class may store the same given identifying information regardless of the printer recording material contained, and the storage device may further store, in addition to the identifying information, color information for the printer recording material contained therein. In this way, all printer recording material receptacles can be identified, even where all printer recording material receptacles containing specialty color printer recording materials are assigned the same identifying information. The first class may be composed of from 4 to 6 printer recording material receptacles. In this case the frequently used colors cyan, light cyan, magenta, light magenta, yellow and black may be assigned to the first class, and a specialty color, namely, black for totally plain paper, assigned to the second class.

The invention in a third aspect thereof provides a system for identifying printer recording material receptacles that identifies a particular printer recording material receptacle from among a multiplicity of printer recording material receptacles comprising a multiplicity of sequentially accessible storage devices. The system for identifying printer recording material receptacles according to this third aspect comprises: a multiplicity of printer recording material receptacles constituting a first group, each receptacle comprising a storage device that stores different identifying information; a multiplicity of printer recording material receptacles constituting a second group, different from the printer recording material receptacles constituting said first group, each receptacle comprising a storage device that stores different identifying information; a first data signal line, said line being bus-connected to the storage devices of the printer recording material receptacles constituting said first group; a second data signal line, said line being bus-connected to the storage devices of the printer recording material receptacles constituting said second group; and information processing control means that utilizes said identifying information to select one or a multiplicity of desired printer recording material receptacles from among said printer recording material receptacles, and that reads or writes information from or to the storage device of one or multiplicity of selected printer recording material receptacles using said first data signal line and/or said second data signal line.

According to the storage control system pertaining to the third aspect of the invention, data can be sent via the first data signal line to storage devices making up the first group, and data can be sent via the second data signal line to storage devices making up the second group. Accordingly, identifying information need only contain enough information to identify the storage devices within a group, allowing the number of identifiable storage devices to be increased without increasing the data capacity needed to store the identifying information. Further, since the storage devices of each group can be accessed (read or written) simultaneously using the first data signal line and second data signal line, the time required for read/write operations to the storage devices can be reduced.

The storage control system pertaining to the third aspect of the invention may additionally comprise a clock signal line connected to the printer recording material receptacles that constitute said first and second groups; and said information processing control means configured such that a data sequence containing a read/write instruction and identifying information corresponding to the storage device of said selected printer recording material receptacle is transmitted over said first data signal line and/or said second data signal line in sync with a clock signal flowing over said clock signal line, to execute reading/writing of information to the storage device of said one or multiplicity of selected printer recording material receptacles. With this arrangement, the storage devices making up the first group and second group can be accessed in a variety of modes, using the first and second data signal lines.

In the storage control system pertaining to the third aspect of the invention, the storage device of said one or multiplicity of selected printer recording material receptacles may be configured such that on the basis of said transmitted read/write instruction, it either transmits stored information over said first data signal line and/or said second data signal line, or stores information present on said first data signal line and/or said second data signal line. With this arrangement, information can be written to or read from storage devices.

The invention in a fourth aspect thereof provides a system for identifying printer recording material receptacles that identifies a particular printer recording material receptacle from among a multiplicity of printer recording material receptacles comprising a multiplicity of sequentially accessible storage devices, and that performs reading/writing of information from or to the storage device of the selected printer recording material receptacle. The system for identifying printer recording material receptacles according to this fourth aspect comprises: a multiplicity of printer recording material receptacles constituting a first group, each receptacle comprising a storage device that stores different identifying information; a multiplicity of printer recording material receptacles constituting a second group, different from the printer recording material receptacles constituting said first group, each receptacle comprising a storage device that stores different identifying information, said storage devices; a data signal line, said line being bus-connected to the printer recording material receptacles constituting said first and second groups; a first reset signal line connected to the storage devices of the printer recording material receptacles constituting said first group; a second reset signal line connected to the storage devices of the printer recording material receptacles constituting said second group; and information processing control means that holds said first reset signal line or said second reset signal line in the reset state, selects a desired storage device from said storage devices using said identifying information, and that performs reading/writing of identifying information via said data signal line.

According to the storage control system pertaining to the fourth aspect of the invention, a storage device of either the first or second group can be accessed via the first reset signal line or the second reset signal line. Accordingly, identifying information need only contain enough information to identify storage devices within a group, allowing the number of identifiable storage devices to be increased without increasing the data capacity needed to store the identifying information.

The storage control system pertaining to the fourth aspect of the invention may additionally comprise a clock signal line connected to the printer recording material receptacles that constitute said first and second groups; and said information processing control means configured such that, when a printer recording material receptacle of said first group is selected, said second reset signal line is held in the reset state, and a data sequence containing a read/write instruction and identifying information corresponding to the storage device of the selected printer recording material receptacle is transmitted over said data signal line in sync with a clock signal flowing over said clock signal line, to execute reading/writing of information to the storage device of said selected printer recording material receptacle. This arrangement enables exclusive access to a storage device of the first group.

The storage control system pertaining to the fourth aspect of the invention may additionally comprise a clock signal line connected to the printer recording material receptacles that constitute said first and second groups; and said information processing control means configured such that, when a printer recording material receptacle of said second group is selected, said first reset signal line is held in the reset state, and a data sequence containing a read/write instruction and identifying information corresponding to the storage device of the selected printer recording material receptacle is transmitted over said data signal line in sync with a clock signal flowing over said clock signal line, to execute reading/writing of information to the storage device of said selected printer recording material receptacle. This arrangement enables exclusive access to a storage device of the second group.

In a system for identifying printer recording material receptacles pertaining to any of the first to fourth aspects of the invention, each said storage device may comprise:

a memory cell for storing data;

a data bus connected to said data signal line;

an address counter that counts up a counter value in sync with a clock signal input via said clock signal line, indicating a memory area of said memory cell to be accessed, and that when initialized resets the counter to an initial value;

an input/output control device, arranged between said memory cell and said data bus, that controls the direction of data transfer vis-à-vis said memory cell and the direction of data transfer over said data bus, and that when initialized sets the direction of data transfer vis-à-vis said memory cell to the data read direction, and disables connection to said data bus;

a comparator device connected to said data bus, that decides whether input identifying information input via said data bus matches identifying information stored in said memory cell read via said input/output control device; and an access enabling device that enables access to said memory cell when it has been decided that said identifying information matches.

With this arrangement, access is enabled only to a desired storage device. Particularly where a multiplicity of storage devices are provided, it is possible to indicate and access (i.e., read, write etc.) a desired storage device from among the multiplicity of storage devices. When making a determination as to whether identifying information in a storage device matches input identifying information, writing of data to the memory cell is disabled, so the identifying information stored in the memory cell can be kept read-only.

In a system for identifying printer recording material receptacles pertaining to any of the first to fourth aspects of the invention, said storage device may additionally comprise: an instruction decoder connected to said data bus and to said comparator device, that, upon being presented by said comparator device with a decision result that said input identifying information matches identifying information stored in said memory cell, analyzes the read/write command input via said data bus, and on the basis of the result of the analysis requests said input/output control device to switch the direction of data transfer over said data bus; wherein said input/output control device maintains the data transfer direction vis-à-vis said memory cell and the disabled connection to said data bus set during said initialization, until analysis of the read/write command by said instruction decoder is completed.

In a system for identifying printer recording material receptacles pertaining to any of the first to fourth aspects of the invention, said storage devices may store different identifying information for each ink type in association with the ink types contained in said printer recording material receptacles. With this arrangement, it is possible to indicate an ink cartridge containing a particular type of ink, even when a multiplicity of ink cartridges are used.

In a system for identifying printer recording material receptacles pertaining to any of the first to fourth aspects of the invention, said information processing control means may comprise:

a clock signal generating circuit;

a reset signal generating circuit that generates a reset signal for initializing said storage devices;

an identifying information generating circuit that generates identifying information serving as identifying information for a particular storage device from among said multiplicity of storage devices; and a data transmission circuit that in sync with said generated clock signal transmits a data sequence containing said generated identifying information and a read/write command over a said data signal line. Where first and second data signal lines are provided, one data transmission circuit may be provided for each data signal line; and where first and second reset signal lines are provided, one reset signal generating circuit may be provided for each reset signal line.

The invention in a fifth aspect thereof provides a printer recording material receptacle set composed of a multiplicity of printer recording material receptacles, said receptacles comprising sequentially accessible storage devices that at a minimum store information relating to printer recording materials encapsulated therein. The printer recording material receptacle pertaining to the fifth aspect herein comprises a multiplicity of printer recording material receptacles bus-connected to a clock signal line that supplies a clock signal, a reset signal line that supplies a reset signal, and a first data signal line, said receptacles constituting a first printer recording material receptacle group and each comprising a storage device that stores different identifying information; and a multiplicity of printer recording material receptacles that are bus-connected to said clock signal line, to said reset signal line, and to a second data signal line, and that constitute a second printer recording material receptacle group, wherein each said receptacle comprises a storage device that stores different identifying information.

According to the printer recording material receptacle set pertaining to the fifth aspect of the invention, the number of identifiable storage devices can be increased without increasing the data capacity needed to store identifying information. Additionally, data read/write operations can be performed rapidly using the first data signal line and second data signal line.

The invention in a sixth aspect thereof provides a printer recording material receptacle set composed of a multiplicity of printer recording material receptacles, said receptacles comprising sequentially accessible storage devices that at a minimum store information relating to printer recording materials encapsulated therein. The printer recording material receptacle pertaining to the sixth aspect herein comprises a multiplicity of printer recording material receptacle groups including a multiplicity of printer recording material receptacles bus-connected to a clock signal line that supplies a clock signal, a single reset signal line that supplies a reset signal, and a multiplicity of data signal lines, and each having a storage device that stores different identifying information.

The sixth aspect herein can also be implemented as a printer recording material receptacle set composed of a multiplicity of printer recording material receptacles bus-connected to a clock signal line that supplies a clock signal, a multiplicity of reset signal lines that supply a reset signal, and a multiplicity of data signal lines, said receptacles each having a storage device that stores different identifying information. Alternatively it may be implemented as a printer recording material receptacle set composed of a multiplicity of printer recording material receptacles bus-connected to a clock signal line that supplies a clock signal, one or a multiplicity of reset signal lines that supply a reset signal, and a multiplicity of data signal lines, said receptacles each having a storage device that stores different identifying information.

According to the printer recording material receptacle set pertaining to the sixth aspect herein, the number of identifiable storage devices can be increased without increasing the data capacity needed to store identifying information.

The invention in a seventh aspect thereof provides a printer recording material receptacle set composed of a multiplicity of printer recording material receptacles, said receptacles comprising sequentially accessible storage devices that at a minimum store information relating to printer recording materials encapsulated therein. The printer recording material receptacle pertaining to the seventh aspect herein comprises a multiplicity of printer recording material receptacles bus-connected to a clock signal line that supplies a clock signal, a data signal line that transmits a data signal, and a first reset signal line that supplies a first reset signal, said receptacles constituting a first printer recording material receptacle group, and each having a storage device that stores different identifying information; and a single printer recording material receptacle bus-connected to said clock signal line, said data signal line, and a second reset signal line that supplies a second reset signal, said receptacle constituting a second printer recording material receptacle group.

According to the printer recording material receptacle set pertaining to the seventh aspect herein, the number of identifiable storage devices can be increased without increasing the data capacity needed to store identifying information. Additionally, the first printer recording material receptacle group may contain the frequently used printer recording materials cyan, magenta, yellow and black, while the second printer recording material receptacle group may contain a specialty color printer recording material used in particular applications, such as dark yellow or black. By so doing all printer recording material receptacles can be identified, even where a printer recording material receptacle containing a specialty color printer recording material is assigned arbitrary identifying information, such as the same identifying information for all specialty colors. Data read and write operations can be executed quickly using the first data signal line and second data signal line.

In a printer recording material receptacle set pertaining to any of the fifth to seventh aspects of the invention, identifying information stored in a storage device of said first printer recording material receptacle group may be identical to identifying information stored in a storage device of the second printer recording material receptacle group. Since a storage device of the first printer recording material receptacle group and a storage device of the second printer recording material receptacle group can be accessed independently, it is sufficient for devices to be identifiable within their respective printer recording material receptacle groups.

The invention in an eighth aspect thereof provides a method for identifying a printer recording material receptacle to which access is desired from among a first printer recording material receptacle group comprising a multiplicity of nonvolatile, sequentially accessible storage devices bus-connected to a clock signal line, a reset signal line and a first data signal line, and having unique identifying information, and a second printer recording material receptacle group comprising a multiplicity of nonvolatile, sequentially accessible storage devices bus-connected to a clock signal line, a reset signal line and a second data signal line, and having unique identifying information. The identifying method pertaining to the eighth aspect herein comprises the steps of: outputting a reset signal to said reset signal line; and transmitting a data sequence over said first data signal line and/or said second data signal line in sync with the clock signal, said data sequence including a read/write instruction and identifying information for the storage device of said printer recording material receptacle printer recording material receptacle to which access is desired.

According to the identifying method pertaining to the eighth aspect herein, there are provided advantages analogous to those of the printer recording material receptacle system pertaining to the third aspect herein. The identifying method pertaining to the eighth aspect herein, like the printer recording material receptacle system pertaining to the third aspect herein, may assume various embodiments.

The invention in a ninth aspect thereof provides a method for identifying a printer recording material receptacle to which access is desired from among a first printer recording material receptacle group comprising a multiplicity of nonvolatile, sequentially accessible storage devices bus-connected to a clock signal line, a data signal line and a first reset signal line, and having unique identifying information, and a second printer recording material receptacle group comprising a multiplicity of nonvolatile, sequentially accessible storage devices bus-connected to a clock signal line, a data signal line, and a second reset signal line, and having unique identifying information. The identifying method pertaining to the ninth aspect herein comprises the steps of: transmitting a reset signal to said first reset signal line and said second reset signal line on the basis of an access request to said printer recording material receptacle; deciding if the printer recording material receptacle to which access has been requested belongs to said first group or said second group; in the event it is decided that said printer recording material receptacle to which access has been requested belongs to said first group, halting transmission of the reset signal to said first reset signal line; and transmitting to said data signal line, in sync with the clock signal, a data sequence that includes a read/write instruction and identifying information for the storage device of said printer recording material receptacle printer recording material receptacle to which access has been requested.

In the identifying method pertaining to the ninth aspect herein, in the event it is decided that said printer recording material receptacle to which access has been requested belongs to said second group, transmission of the reset signal to said second reset signal line is halted; and a data sequence that includes a read/write instruction and identifying information for the storage device of said printer recording material receptacle printer recording material receptacle to which access has been requested is transmitting to said data signal line, in sync with the clock signal.

According to the identifying method pertaining to the ninth aspect herein, there are provided advantages analogous to those of the printer recording material receptacle system pertaining to the fourth aspect herein. The identifying method pertaining to the ninth aspect herein, like the printer recording material receptacle system pertaining to the fourth aspect herein, may assume various embodiments.

BRIEF DESCRIPTION OF THE DRAWINGS

A fuller understanding of the system for identifying printer recording material receptacles pertaining to the invention is provided through the following description of the preferred embodiments made with reference to the accompanying drawings wherein.

DESCRIPTION OF THE PREFERRED EMBODIMENTS

A. Conceptual Outline of Identification system Pertaining to Embodiment 1

Figure 1:
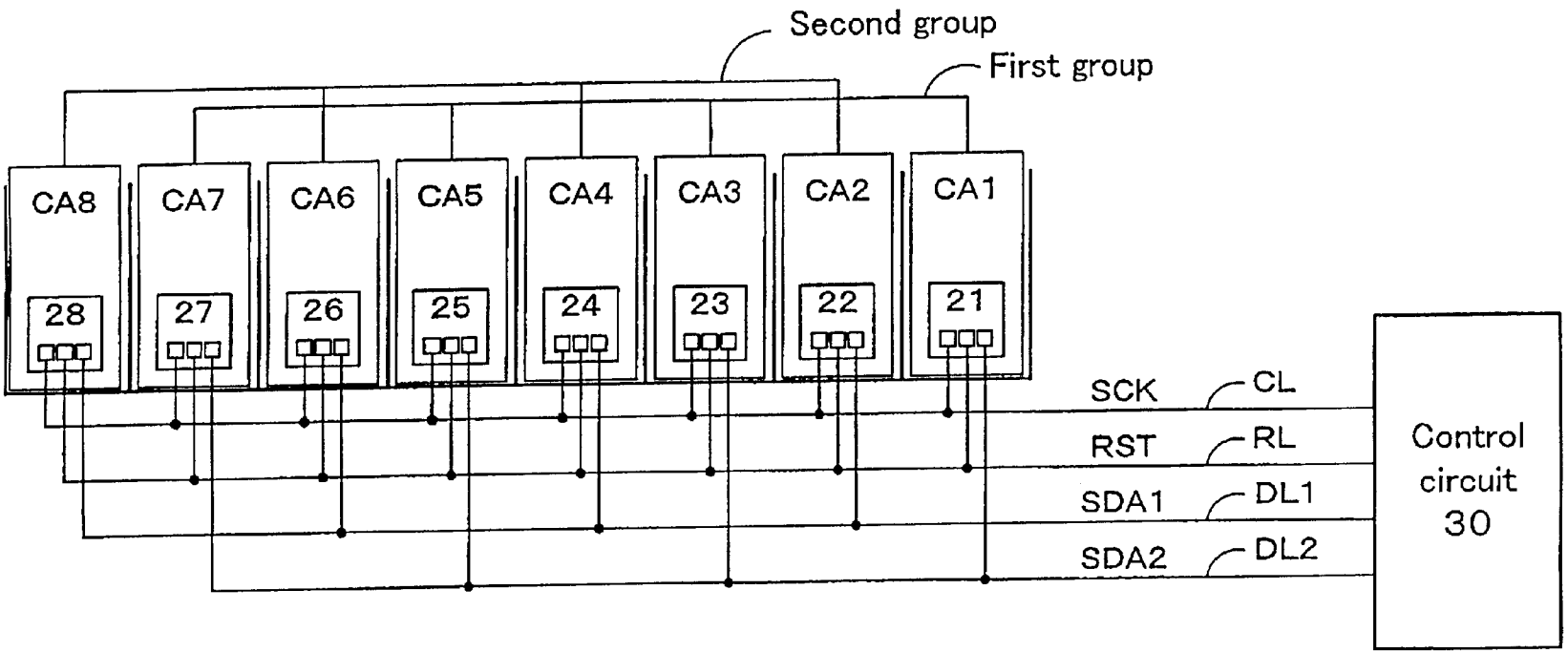
FIG. 1 is an illustrative diagram depicting the features of an identification system pertaining to a first embodiment.

The following conceptual description of the features of an identification system pertaining to Embodiment 1 makes reference to FIG. 1. FIG. 1 is an illustrative diagram depicting the features of the identification system pertaining to Embodiment 1. The eight storage devices 21–28 that make up the identification system of Embodiment 1 are provided to ink cartridges CA1–CA8, each of which contains a printer ink. Of these ink cartridges CA1–CA8, ink cartridges CA1, CA3, CA5 and CA7, i.e., storage devices 21, 23, 25 and 27, belong to a first group; and ink cartridges CA2, CA4, CA6 and CA8, i.e., storage devices 22, 24, 26 and 28, belong to a second group.

Control circuit 30, which controls writing of data to storage devices 21–28 and reading of data from storage devices 21–28, transmits a clock signal SCK and a reset signal RST to storage devices 21–28 via a clock signal line CL and a reset signal line RST. On the one hand, of the data sequences transmitted by control circuit 30, first data SDA1, a data sequence intended for the storage devices 21, 23, 25, 27 of the first group, is supplied via a first data signal line DL1 to the storage devices 21, 23, 25, 27 of the first group. Second data SDA2, a data sequence intended for the storage devices 22, 24, 26, 28 of the second group, is supplied via a second data signal line DL2 to the storage devices 22, 24, 26, 28 of the second group.

Typically, where devices such as storage devices are connected to signal lines over a bus, identifying information is used to indicate a particular storage device to be accessed. This identifying information is used to identify storage devices, and thus where useable data capacity is limited, for example, where stored in storage devices as 3-bit data, identification becomes impossible once the number of storage devices to be identified exceeds 9.

In this embodiment, on the other hand, storage devices 21–28 are divided into two groups, accessing the storage devices 21, 23, 25, 27 of the first group using the first data signal line DL1, and accessing the storage devices 22, 24, 26, 28 of the second group using the second data signal line DL2. Thus the number of storage devices to be identified can be increased without expanding the data capacity needed for identifying information, and it also becomes possible to simultaneously access a storage device of the first group and a storage device of the second group, reducing the time needed to access storage devices. Where 3 bits are assigned to identifying information, from 2 to 8 ink cartridges CA may be included in each group, and where 2 bits are assigned, from 2 to 4 ink cartridges CA may be included in each group. That is, the number of data signal lines is reduced to the greatest extent possible, while avoiding duplication of identifying information, at least within each group.

B. General Arrangement of Identification System Pertaining to Embodiment 1

Figure 2:
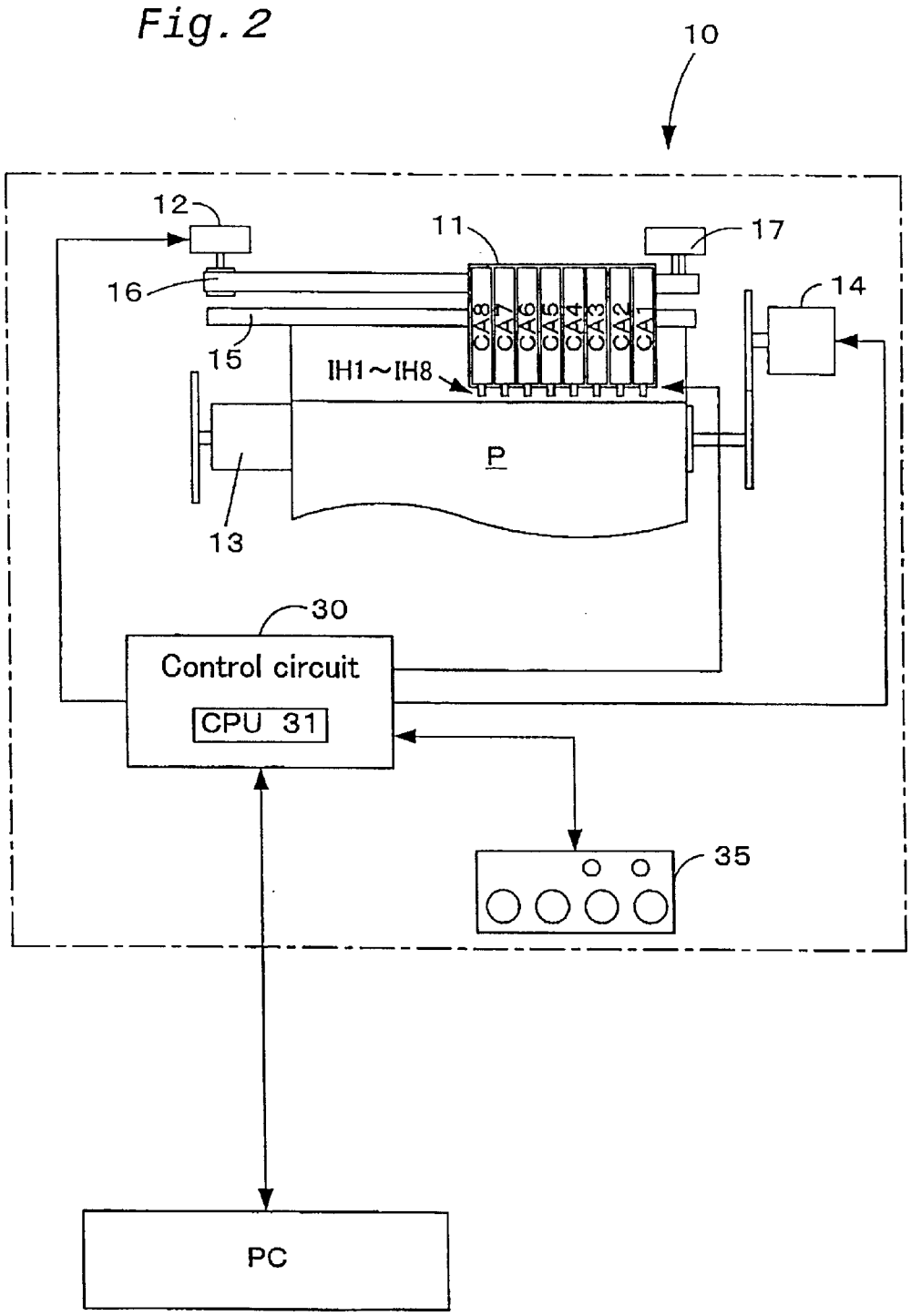
FIG. 2 is an illustrative diagram depicting schematically the internal arrangement of a printer as an exemplary identification system pertaining to the first embodiment.

The following description of the general arrangement of the identification system pertaining to Embodiment 1 makes reference to FIG. 2. FIG. 2 is an illustrative diagram depicting schematically the internal arrangement of a printer as an exemplary identification system pertaining to the first embodiment.

The identification system pertaining to this embodiment is implemented as an ink-jet color printer (printing device). Color printer 10 is an ink-jet format printer capable of outputting color images by ejecting inks of, for example, 8 different colors such as cyan (C), light cyan (LC), magenta (M), light magenta (LM), yellow (Y), dark yellow (DY), black (K) and black for text printing (LK), onto a print medium (printer paper, for example) to produce a dot pattern. While this embodiment is described with reference to a color ink-jet printer, an electrophotographic printer that transfers and fixes colored toner onto a print medium to produce an image could be used as well.

As shown in the drawing, color printer 10 comprises a mechanism that drives print heads IH1–IH8 mounted on a carriage 11, to perform ejection of ink and formation of dots; a mechanism that reciprocates the carriage 11 in the axial direction of a platen 13 by means of a carriage motor 12; a mechanism that feeds cut printer paper P by means of a paper feed motor 14; and a control circuit 30. The mechanism that reciprocates the carriage 11 in the axial direction of platen 13 comprises a slide rail 15, extending parallel to platen 13, that slidably retains carriage 11; a pulley linked by means of an endless drive belt 16 to the carriage motor 12, and the like.

Control circuit 30 performs appropriate drive control of paper feed motor 14, carriage motor 12 and print heads IH1–IH8 while exchanging signals with the control panel 35 of the printer. Ink cartridges CA1–CA8 are installed on carriage 11. Ink cartridge CA1 contains, for example, black (K) ink, ink cartridge CA2 text black (CK) ink, ink cartridge CA3 cyan (C) ink, ink cartridge CA4 light cyan (LC) ink, ink cartridge CA5 magenta (M) ink, CA6 light magenta (LM) ink, CA7 yellow (Y) ink, and CA8 dark yellow (DY) ink.

Control circuit 30 performs appropriate drive control of paper feed motor 14, carriage motor 12 and print head 11 while exchanging signals with the control panel 35 of the printer. Printer paper P supplied to color printer 10 is set pinched between platen 13 an auxiliary paper feed roller, and advanced in prescribed increments depending on the rotation angle of platen 13. By means of an internal CPU 31, control circuit 30 performs data write and data read operations on storage devices 21–28 of ink cartridges CA1–CA8 on the basis of control signals from the personal computer PC. In this embodiment, control circuit 30 executes the printing process by controlling operation of the components of printer 10 in accordance with print control signals received from personal computer PC.

Figure 3:
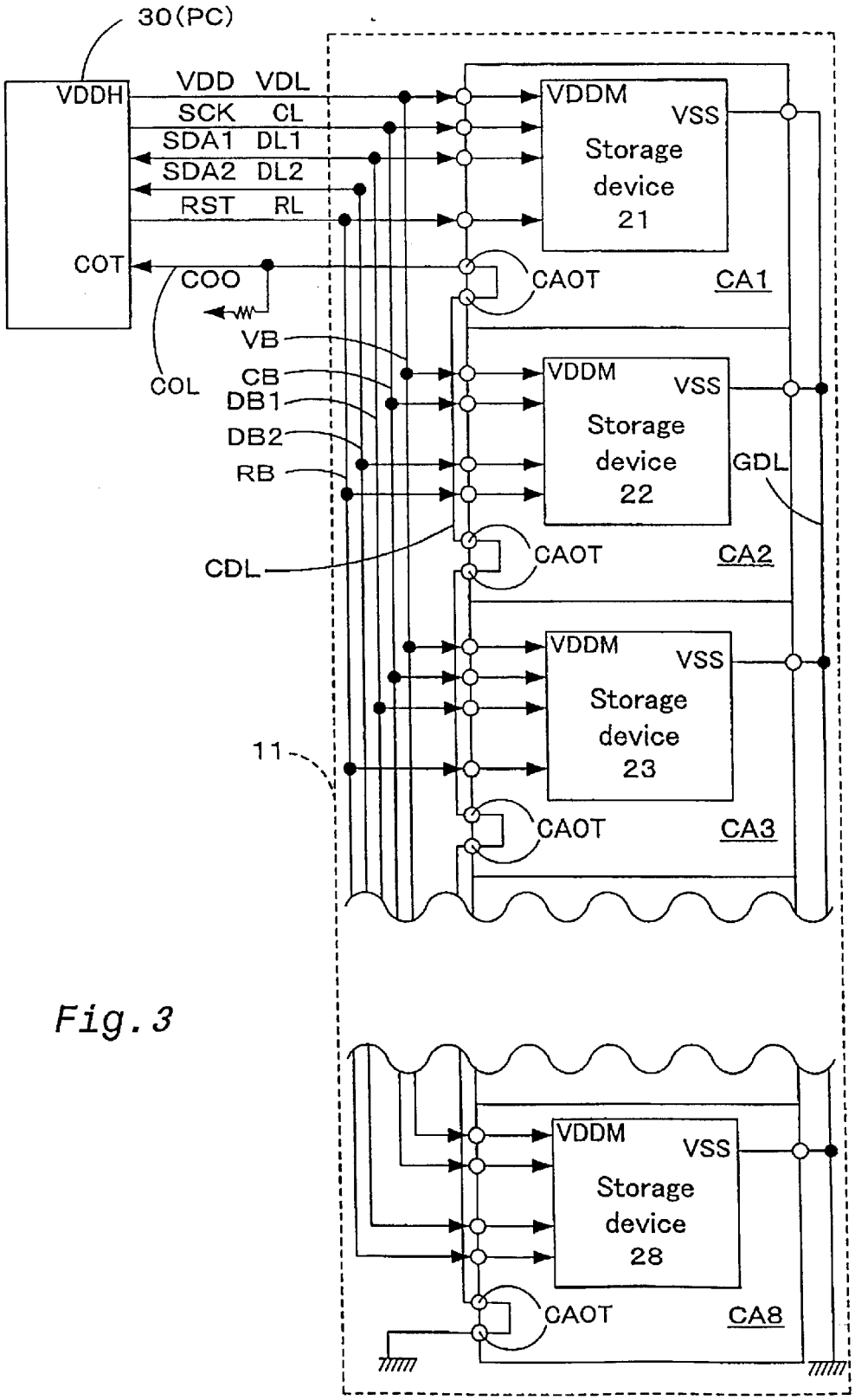
FIG. 3 is a block diagram showing interconnections between a control circuit 30 (personal computer PC) and the storage devices 21–28 of ink cartridges CA1–CA8.

The following description of interconnections of the storage devices of ink cartridges with control circuit 30 (personal computer PC) makes reference to FIG. 3. FIG. 3 is a block diagram showing interconnections between a control circuit 30 (personal computer PC) and the storage devices 21–28 of ink cartridges CA1–CA8. To facilitate the description, in FIG. 3 only the ink cartridges CA1, CA2, CA3, CA8 provided with the storage devices 21, 22, 23, 28 are shown schematically as representative; the actual identification system of this embodiment will be provided with ink cartridges CA1–CA8 having storage devices 21–28, as shown in FIG. 1. The arrangement of the identification system of this embodiment is not limited to that illustrated in FIG. 3.

Storage devices 21–28 are provided to the eight-color ink-jet printer ink cartridges CA1–CA8 shown in FIG. 1. In this embodiment, the storage devices are EEPROM, non-volatile devices that retain stored information, and that allow stored information to be rewritten.

Figure 5:
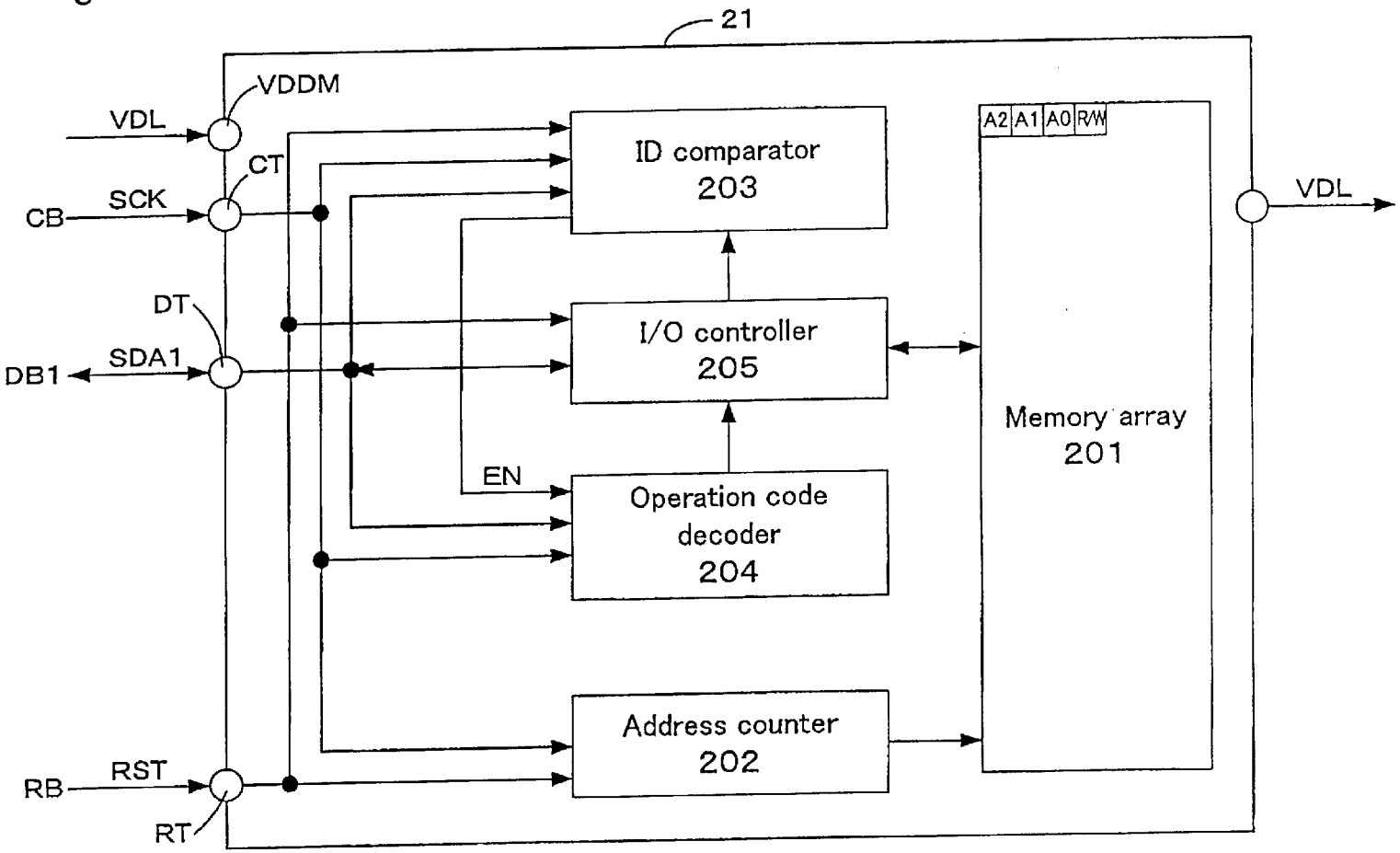
FIG. 5 is a block diagram showing the internal circuitry of a storage device 21 according to the first embodiment.

The data signal terminals DT, clock signal terminals CT, and reset signal terminals RT of the storage devices 21–28 are respectively connected to a first and second data bus DB1, DB2, a clock bus CB, and a reset bus RB (see FIG. 3 and FIG. 5). The storage devices 21, 23, 25, 27 of the first group are connected to first data bus DB1, and the storage devices 22, 24, 26, 28 of the second group to second data bus DB2, respectively. Control circuit 30 on the one hand, and first data bus DB1 and second data bus DB2 on the other, are connected via a first data signal line DL1, second data signal line DL2, clock signal line CL, and reset signal line RL. Accordingly control circuit 30 is provided with two buffer memories, one for each of the data signal lines DL1, DL2, that temporarily store data sequences for transmission to the first data signal line DL1 and second data signal line DL2. Flexible feed cable (FFC), for example, may be used for signal lines.

The positive power terminal VDDH of control circuit 30 is connected to the positive power terminals VDDM of storage devices 21–28 through a power line VDL. The negative power terminals VSS of storage devices 21–28 are connected to a ground line GDL on carriage 11. On carriage 11 is situated a cartridge out detection line CDL to which cartridge out detection terminals CAOT provided to ink cartridges CA1–CA8 are connected in a cascade connection. One terminal of cartridge out detection line CDL is grounded, while the other terminal is connected via a cartridge out detection line COL to the cartridge out detection terminal COT of personal computer PC.

In this embodiment, since a dedicated ground line GDL is connected to the negative power terminals VSS of storage devices 21–28, any of the storage devices 21–28 can be accessed by personal computer PC even if not all of the ink cartridges CA1–CA8 are installed. This arrangement is particularly useful when initially installing ink cartridges CA, or when simultaneously replacing more than one ink cartridge CA.

Control circuit 30 is a controller device that, via CPU 31, performs a clock signal generating function, a reset signal generating function, a power monitoring function, and control functions for controlling the power circuit, backup power circuit, data storage circuit and various circuits; it also controls access to storage devices 21–28. Control circuit 30 is located in the chassis of color printer 10, and when powered on acquires data, namely ink consumption and ink cartridge installation time, from the storage devices 21, 23, 25, 27 of the first group via the first data signal line DL1, and from the storage devices 22, 24, 26, 28 of the second group via the second data signal line DL2, and stores this information in a data storage circuit. When powered off, it writes data, namely ink consumption and ink cartridge installation time, to the storage devices 21, 23, 25, 27 of the first group via the first data signal line DL1, and to the storage devices 22, 24, 26, 28 of the second group via the second data signal line DL2.

Control circuit 30 accesses storage devices 21–28 inter alia when the ink jet printer is powered up, when an ink cartridge is replaced, when a print job is completed, or when the ink jet printer experiences power interruption, and so on. When accessing storage devices 21–28, control circuit 30 requests the reset signal generating circuit to generate a reset signal. Thus, a reset signal will be generated in case of a power outage, or if the power cord is unplugged. CPU 31 controls the backup power circuit to supply power for a predetermined time interval (0.3 s, for example) even if the power supply should be interrupted. Thus, if the power should be interrupted while data is being written, due to a power outage of the power cord being unplugged, during the aforementioned time interval it will be possible to complete the data write operation of data assigned priority for writing. The backup power circuit may consist of a capacitor, for example.

Control circuit 30 also controls the power circuit to output positive power. The control circuit 30 of this embodiment does not normally supply power to storage devices 21–28, but rather supplies positive power to storage devices 21–28 only in the event that there is an access request to storage devices 21–28.

Figure 4:
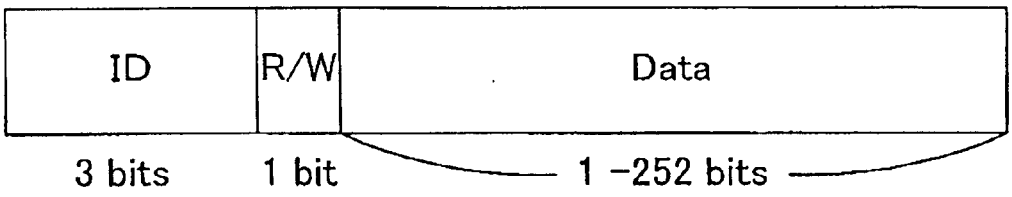
FIG. 4 is an illustrative diagram depicting an exemplary data sequence transmitted from personal computer PC to storage devices 21–28.

The following description of a data sequence transmitted from personal computer PC (control circuit 30 refers to FIG. 4. FIG. 4 is an illustrative diagram depicting an exemplary data sequence transmitted from personal computer PC to storage devices 21–28.

The data sequence transmitted from personal computer PC shown in FIG. 4 comprises a 3-bit identifier data portion, a 1-bit read/write command portion, and a 1-bit 252-bit write/read data portion. Where data is to be read from storage devices 21–28, personal computer PC controls the clock signal generating circuit of control circuit 30 to generate a clock signal SCK at intervals of 4 $\mu$S, for example, and where data is to be written to storage devices 21–28, generates a clock signal SCK at intervals of 3 ms.

The following description of the internal arrangement of storage devices 21–28 refers to FIG. 5. FIG. 5 is a block diagram showing the internal circuitry of a storage device 21. As the internal arrangement of each individual storage device is the same, apart from the identifying information (identifier data) stored therein, the following description will focus on the internal arrangement of storage device 21 as representative.

Storage device 21 comprises a memory array 201, address counter 202, ID comparator 203, operation code decoder 204, and I/O controller 205.

Memory array 201 has a memory area of predetermined capacity, for example, 256 bits. Identifier data is stored in the leading 3 bits of the memory area, with the memory area of the fourth bit being a null area. As noted, under normal circumstances the leading 3 bits of a data sequence from the host computer contain identifier data, and the fourth bit contains a read/write command. Therefore, data can only be written to the memory area starting at the fifth bit, and by providing this arrangement to the memory area of memory array 201, the leading four bits constitute a read-only memory area. Memory array 201 has a memory area starting at the fifth bit, for writing information assigned priority in writing, for example, information relating to ink consumption or remaining ink. By providing this arrangement, important data can be written to memory array 201 during the time interval that power is supplied by the backup power circuit, even if the power should be interrupted for some reason other than turning off the power switch.

Writing to the leading 3 bits is accomplished by writing to memory area 201 an amount of data equal to the capacity of memory array 201 when writing identifying information. In this embodiment, memory array 201 has 256-bit capacity, so the computer writing the identifying information will first write 252 bits of data to the 5th to 256th bits, then attempt to write 3 bits of data (identifying information) to the 257th to 259th bits of memory array 201. Since all bits up through the 256th bit of the address of memory array 201 have already been written at this point, the newest data will be written to the leading bits 1–3 of memory array 201. As a result, identifying information (ID data) will be written to the leading 3 bits of memory array 201.

Address counter 202 is a circuit that increments a counter value in sync with the clock signal SCK, and is connected to memory array 201. Counter values are associated with memory area locations (addresses) in memory array 201, so that a location to be written to or read from in memory array 201 can be indicated by the counter value. Address counter 202 is also connected to reset signal terminal RT, and when a reset signal RST is input resets the counter to the initial value. Here, the initial value can be any value associated with the leading location in memory array 201; typically, an initial value of 0 is used.

ID comparator 203 is connected to clock signal terminal CT, data signal terminal DT, and reset signal terminal RT, and decides if a identifier data contained in a data sequence input via data signal terminal DT matches identifier data stored in memory array 201. To describe in greater detail, ID comparator 203 has a 3-bit register (not shown) for storing identifier data contained in a data sequence, and a 3-bit register (not shown) for storing identifier data acquired from memory array 201, and decides whether the identifying information matches depending on whether the values in the two registers match. If the identifying data matches, ID comparator 203 outputs an access enable signal EN to the operation code decoder 204. When a reset signal RST is input the ID comparator 203 clears the values in the registers. The ID comparators 203 of storage device 21 and the other storage devices 22–28 store common identifier data, for example, (1, 1, 1) in this embodiment. By providing the ID comparators of the storage devices 21–28 with common identifier data, data to be written in common to the storage devices 21–28 can be written simultaneously.

The operation code decoder 204 is connected to I/O controller 205, clock signal terminal CT and data signal terminal DT; it acquires the data of the 4th bit input after reset signal RST has been input, that is, the read/write command. When an access enable signal EN is input, code decoder 204 analyzes the acquired read/write command and transmits either a write operation request or read operation request to the I/O controller 205.

I/O controller 205 is connected to data signal terminal DT and memory array 201, and in accordance with a request from the operation code decoder 204 switches the direction of data transfer vis-à-vis the memory array 201, and the direction of data transfer vis-à-vis the data signal terminal DT (i.e. over the signal line connected to data signal terminal DT). I/O controller 205 is also connected to the reset signal terminal RT and receives reset signal RST. I/O controller 205 comprises a first buffer memory (not shown) that temporarily stores data read from the memory array 201 and data to be written to the memory array 201, and a second buffer memory (not shown) that temporarily stores data from the data bus DB and data destined for the data bus DB.

I/O controller 205 is initialized through input of reset signal RST, and when initialized sets the direction of data transfer vis-à-vis the memory array 201 to the read direction, and sets the signal line connected to the data signal terminal DT to high impedance so as to disable transfer of data via data signal terminal DT. This initialized state is maintained until there is a write operation request or read operation request from the operation code decoder 204. Thus, once a reset signal has been input, data carried in the leading four bits of a data sequence input via data signal terminal DT is not written to the memory array 201, while data stored in the leading four bits of memory array 201 (of which the 4th bit is null data) is transmitted to ID comparator 203. As a result, the leading four bits in memory array 201 are read-only.

C. Operation of Identification System in Embodiment 1

Figure 6:
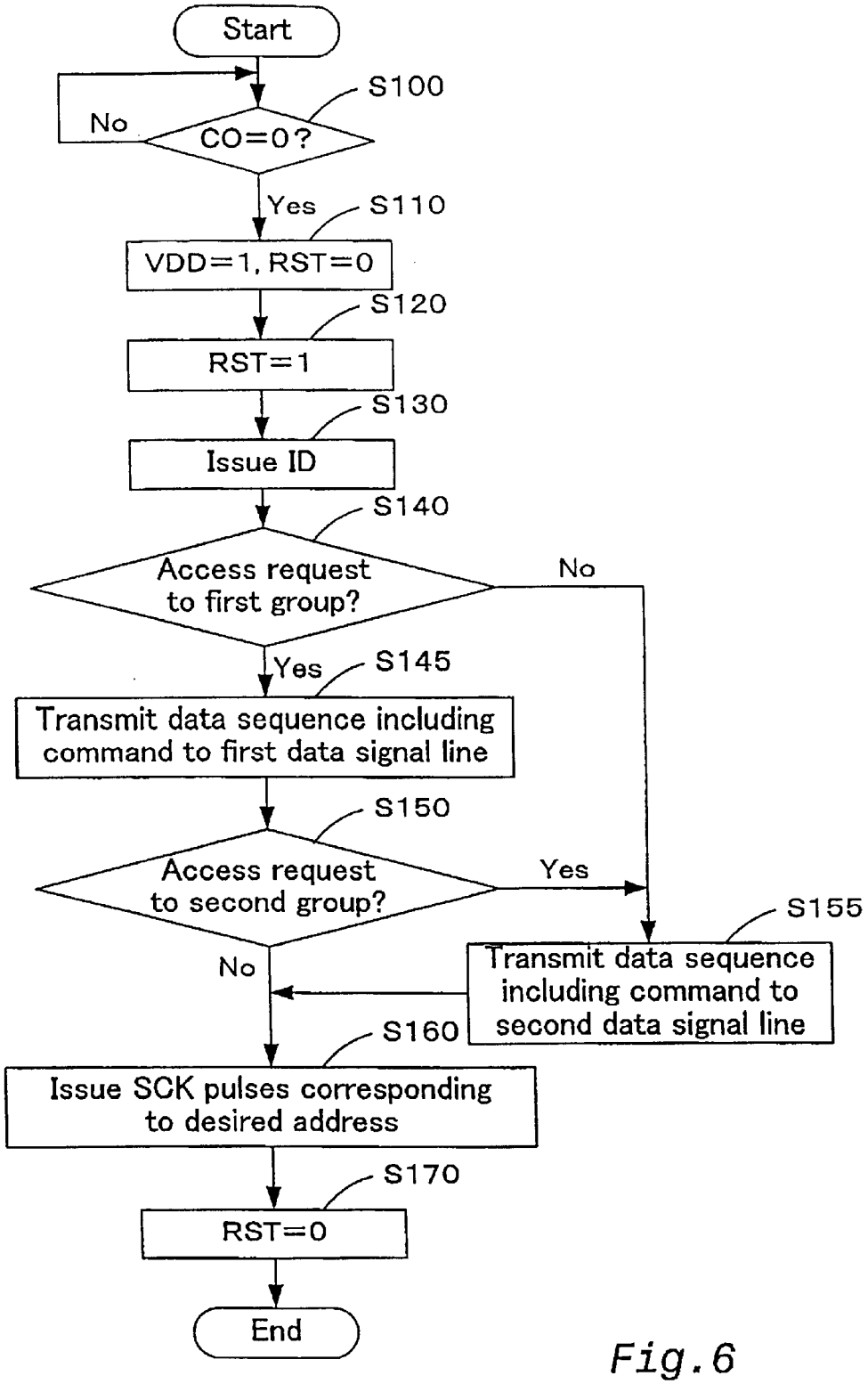
FIG. 6 is a flow chart showing the processing routine executed by control circuit 30 when accessing of storage devices 21–28.
Figure 7:
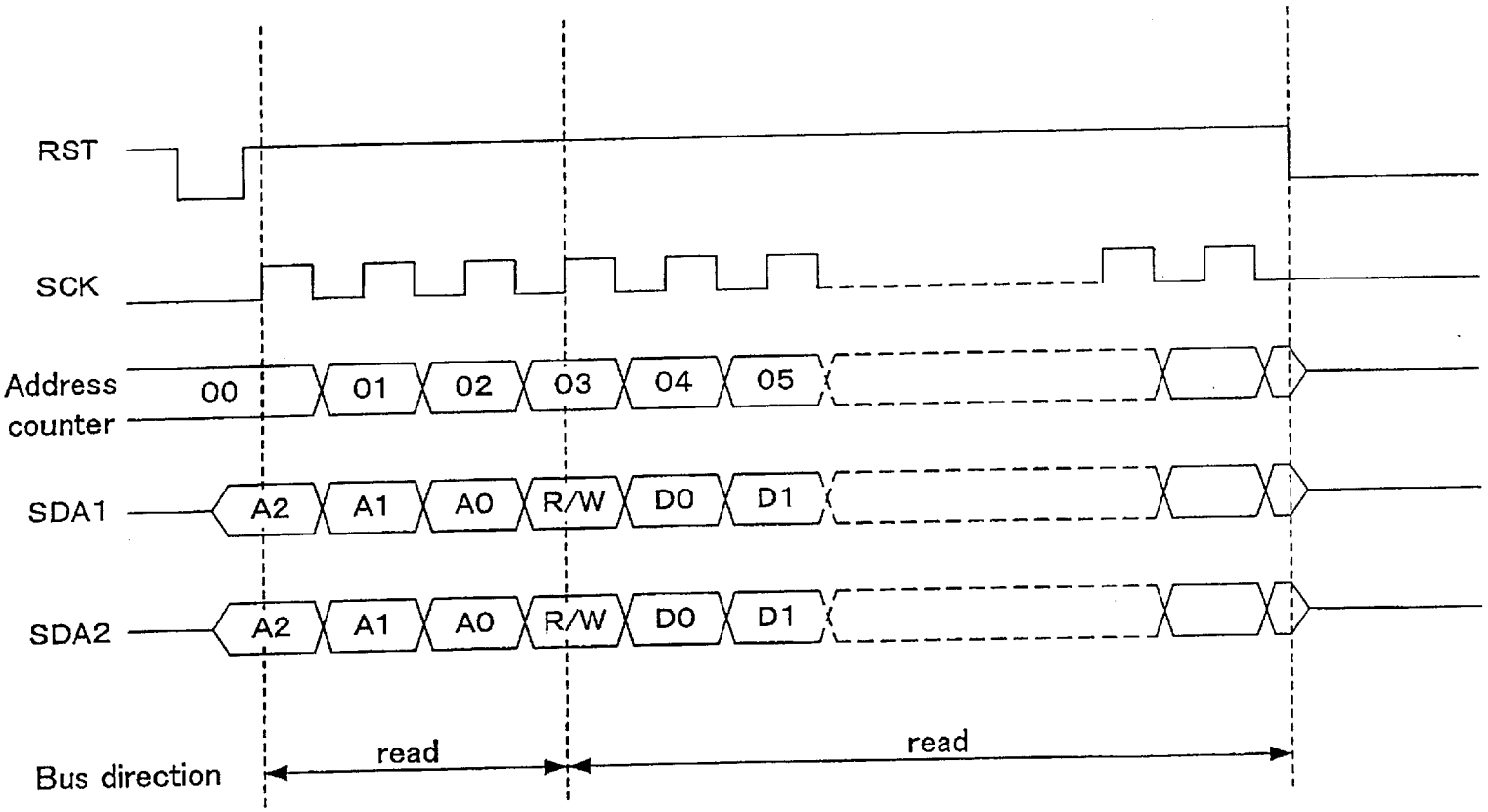
FIG. 7 is a timing chart showing timing relationships of the reset signal RST, clock signal SCK, first and second data signals CDA1, CDA2, and address counter value when reading data.
Figure 8:
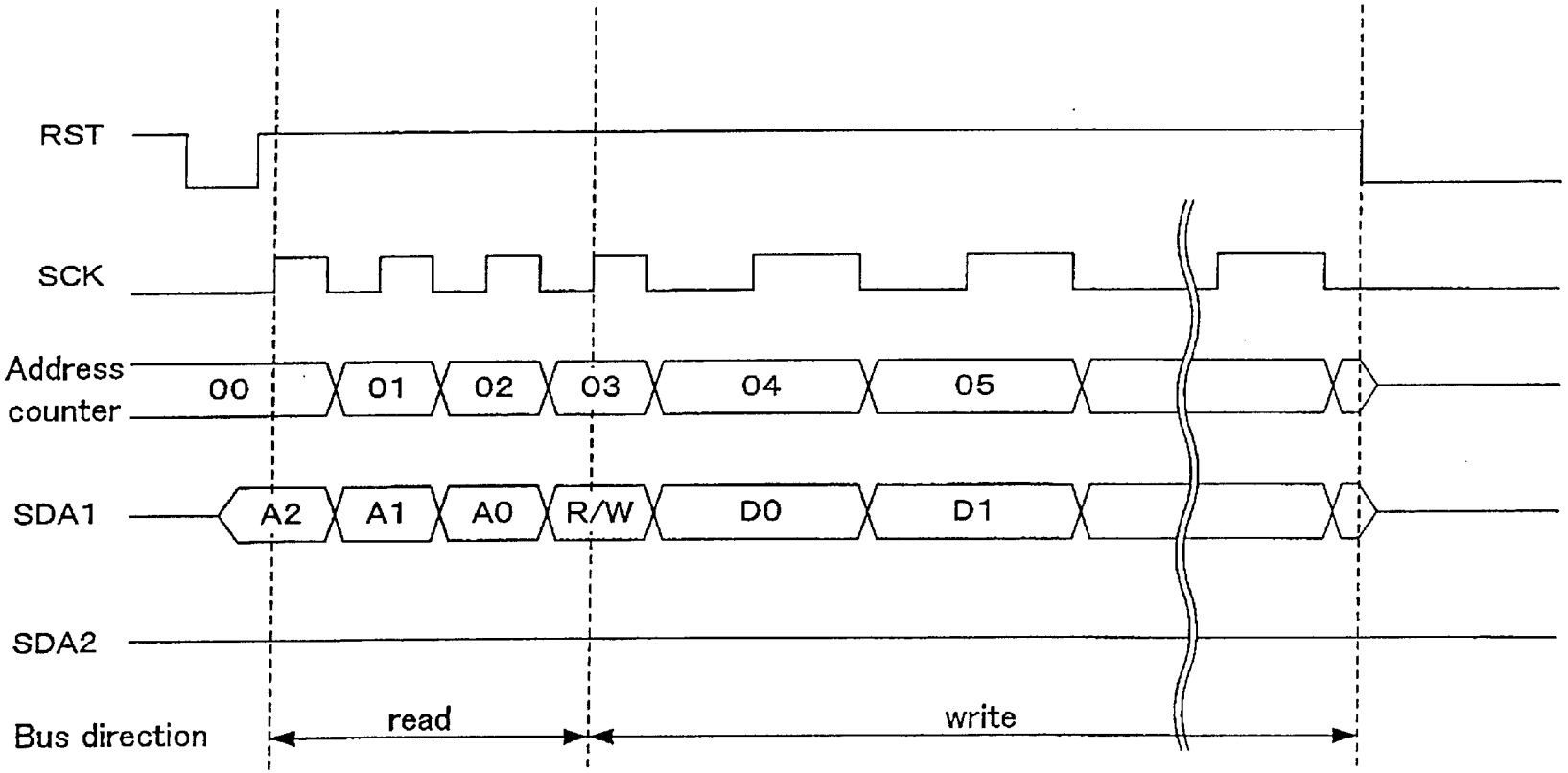
FIG. 8 is a timing chart showing timing relationships of the reset signal RST, clock signal SCK, first and second data signals CDA1, CDA2, and address counter value when writing data.

The following description of operation of the identification system in this embodiment makes reference to FIGS. 6–8. FIG. 6 is a flow chart showing the processing routine executed by control circuit 30 when accessing storage devices 21–28. FIG. 7 is a timing chart showing timing relationships of the reset signal RST, clock signal SCK, first and second data signals CDA1, CDA2, and address counter value when reading data. FIG. 8 is a timing chart showing timing relationships of the reset signal RST, clock signal SCK, first and second data signals CDA1, CDA2, and address counter value when writing data.

The CPU 31 of control circuit 30 waits until the input value CO of cartridge out signal line COL goes to 0 (Step S100: No). That is, if all of the ink cartridges are properly seated in the ink cartridge holder, since the negative power line VSL is serially connected and therefore grounded, the input value CO of cartridge out signal line COL will indicate ground voltage (about 0 V, for example). If, on the other hand, even a single ink cartridge is not properly seated in the ink cartridge holder, the negative power line VSL is not serially connected and therefore not grounded, so a value corresponding to the circuit voltage of the control circuit will appear on the cartridge out signal line COL. In this embodiment, the effects of noise etc. are eliminated through binarization on the basis of a predetermined threshold value. Thus, the input value of the cartridge out signal line COL will assume the value 0 or 1.

Once the input value CO of cartridge out signal line COL goes to 0 (Step S100: Yes), as shown in FIGS. 7 and 8 CPU 31 supplies power supply voltage (VDD=1) to the positive power terminals VDDM of storage devices 21–28 via power supply line VDL, and causes the reset signal generating circuit to generate a reset signal (set RST=0) which is transmitted to the reset bus RB via the reset signal line RL (Step S110). In other words, power supply voltage is not supplied to storage devices 21–28 unless the ink cartridges are properly seated in the ink cartridge holder. It should be noted that since the reset signal RST is active low, the expression "generate and input a reset signal RST" herein refers to a reset low signal unless indicated otherwise.

As shown in FIGS. 7 and 8, CPU 31 then sets the reset signal generating circuit to RST=1 to set the reset signal RST to High (Step S120). CPU 31 then issues identifier data (ID data) for the ink cartridges CA1–CA8 (storage devices 21–28) to which access is desired (Step S130). The ID data is transmitted to data bus DB over data signal line DL, in sync with the rising edge of the clock signal SCK, as shown in FIGS. 7 and 8. In this embodiment, it is not necessary to divide ID data into ID data for the storage devices 21, 23, 25, 27 belonging to the first group and ID data for the storage devices 22, 24, 26, 26 belonging to the second group. That is, it is sufficient for storage devices to be identified within the first group and second group; identification beyond the group level is not required. Thus, four patterns of ID data will suffice. Alternatively, as the number of ink cartridges CA is 8 and 3-bit data is assigned to ID data in this embodiment, individual ink cartridges may be identified by assigning unique ID data across the first and second groups. ID data (1, 1, 1) is identifier data is stored in the ID comparators of all storage devices 21–28, allowing data to be written simultaneously to all storage devices 21–28 when the issued ID data is (1, 1, 1).

CPU 31 decides whether the access request is directed to a storage device 21, 23, 25, 27 of the first group (Step S140). If CPU 31 determines that the access request is directed to a storage device 21, 23, 25, 27 of the first group (Step S140: Yes) it issues either a read command (Read) or a write command (Write) to the first data signal line DL1 (Step S145). The issued command is transmitted to the first data bus DB1 via the first signal line DL1. As shown in FIGS. 7 and 8 the command is transmitted to the first data bus DB1 in sync with the rising edge of the fourth [pulse of] the clock signal SCK, after the reset signal RST has switched from Low to High.

In this embodiment, where the issued command is a Write command, CPU 31 requests the clock signal generating circuit to lower the speed of the clock signal SCK, that is, to extend the interval at which clock signal SCK [pulses] are generated. Where the issued command is a Read command, clock signal speed is maintained as shown in FIG. 7. The time required to write data to EEPROM is about 3 ms, for example, whereas the time required to read data is about 4 $\mu$s, for example. Accordingly the time required to write data is about 1000 times longer that than required to read data. Therefore, storage devices 21, 22, 23, 28, 24 are accessed at faster clock signal speed until a data Write command is issued, slowing down the clock signal speed during a data write operation, thereby reducing the time required for access while ensuring that data writing is reliable.

CPU 31 also decides whether the access request is directed to a storage device 22, 24, 26, 28 of the second group (Step S150). In this embodiment, since two data signal lines DL1, DL2 are used, simultaneous access of and writing of different data to the two groups is possible. If CPU 31 determines that the access request is directed to a storage device 22, 24, 26, 28 of the second group (Step S150: Yes) it issues either a read command (Read) or a write command (Write) to the second data signal line D1 (Step S155). CPU 31 also issues a command to the second data signal line D1 (Step S155) in the event that it determines in Step S140 that the access request is not directed to a storage device 21, 23, 25, 27 of the first group (Step S140: No). The issued command is transmitted to the second data bus DB2 via the second signal line DL2. As shown in FIGS. 7 and 8 the command is transmitted to the second data bus DB2 in sync with the rising edge of the fourth [pulse of] the clock signal SCK, after the reset signal RST has switched from Low to High.

If in Step S150 the CPU 31 has determined that an access request is not directed to a storage device 22, 24, 26, 28 of the second group (Step S150: No), or after transmitting a command to the second data signal line DL2 in Step S155, it issues clock signal pulses in a number corresponding to an address (location) in the memory array to be written to or read from, for example, an address in memory array 201 of storage device 21 (Step S160). In this embodiment, storage devices 21–28 are sequentially accessible storage devices, so it will be necessary to issue clock signal pulses corresponding in number to the address to which access (read or write) is desired, and to increment the counter value in the address counter 202 until the count value corresponds to the selected address.

Finally, CPU 31 causes the reset signal generating circuit to generate a reset low signal (set RST=0) that is transmitted to the reset bus RB via reset signal line RL, thereby terminating access of storage devices 21–28. Since access is terminated by transmitting a reset signal (reset low signal) in this way, and since a reset signal RST is transmitted also in the event of a power interruption, the write operation is allowed to terminate normally, at least for data that has finished writing.

D. Operation of Storage Devices in Embodiment 1

Figure 9:
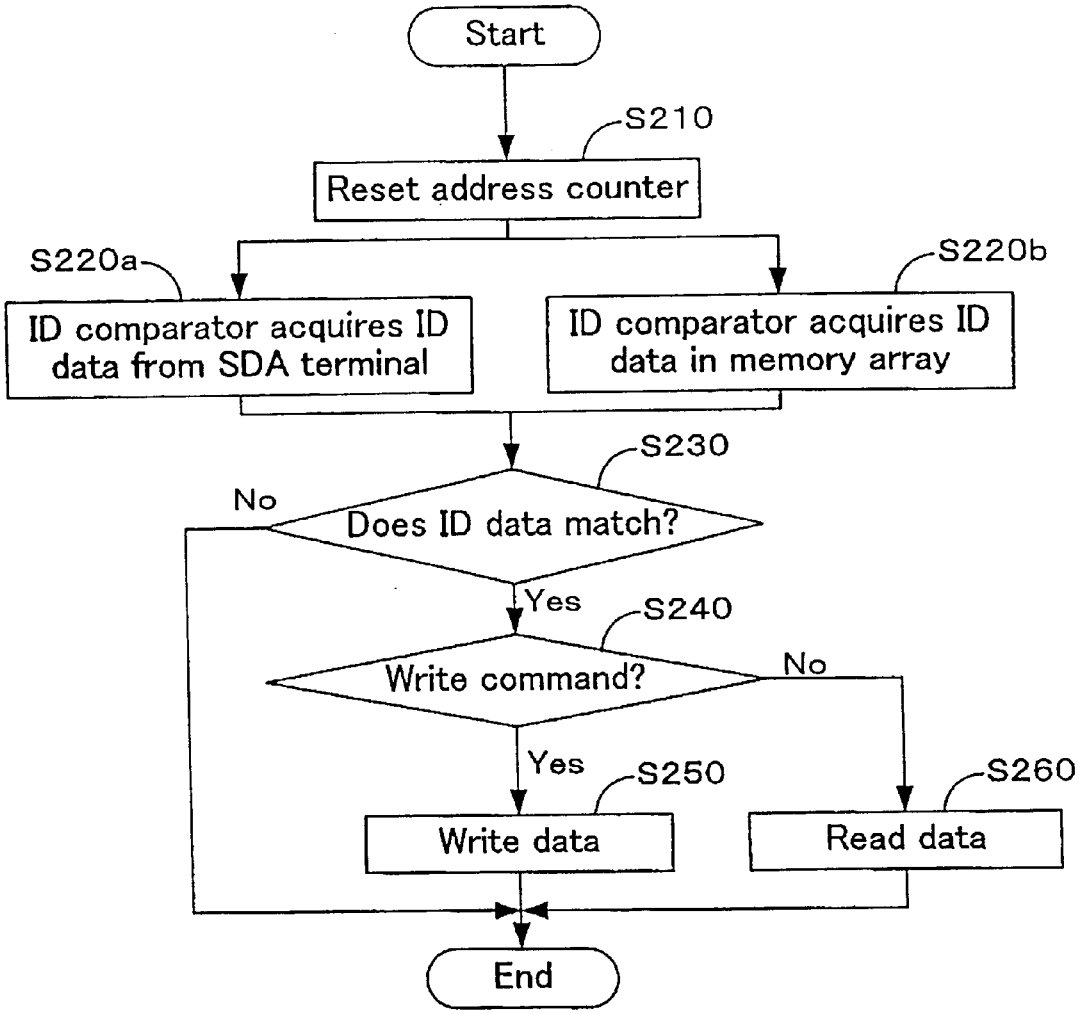
FIG. 9 is a flow chart showing the processing routine executed by the circuits of storage devices 21–28 when accessed by control circuit 30.

The following description of processes performed in the circuitry of the storage devices 21–28 when accessed by the control circuit 30 makes reference to FIG. 9. The following description will focus on storage device 21 of the first group as representative, but storage devices belonging to the second group will of course operate in the same manner.

The various constituent devices of storage device 21 operate on the basis of various signals sent from CPU 31. The following description of operations of storage device 21 under signal output timing output by CPU 31 makes reference to FIGS. 7 and 8.

When a reset low signal is input to the reset bus RB, the address counter 202 resets the counter value to the initial value (0) (Step S210). The ID comparator 203 and I/O controller 205 are also initialized. Specifically, the two registers in the ID comparator are cleared, and the I/O controller 205 sets the direction of data transfer vis-à-vis the memory array 201 to the read direction, and sets the signal line connected to the data signal terminal DT to high impedance so as to disable transfer of data.

As described previously, when the reset signal RST switches from Low to High, data of various kinds is transmitted in sync with the rising edge of clock signal SCK. When a given signal RST switches from Low to High, address counter 202 increments the counter value in increments of 1 from the initial counter value, in sync with the rising edge of clock signal SCK.

In sync with the rising edge of the three clock signal SCK [pulses] following a switch of reset signal RST from Low to High, the ID comparator 203 acquires data sent to the data bus DB, namely, 3-bit ID data, and stores this in a first 3-bit register (Step S220*a*). At the same time, the ID comparator 203 acquires data from the address in memory cell 201 indicated by the counter value 00, 01, 02 in the address counter 202, that is, acquires the identifier data in the memory cell 201, and stores this in a second 3-bit register (Step S220*b*).

The ID comparator 203 then decides whether the ID data (identifier data) stored in the first and second registers matches (Step S230). The ID comparator 203 also decides whether the ID data in the first register matches the preset common ID data. If ID comparator 203 determines that ID data does not match (Step S230: No), it does not enable access to memory array 201 by the CPU 31, and the access process in storage device 21 terminates. In this event access to any of the other storage devices 23, 25, 27 of the first group is enabled.

If on the other hand the ID comparator 203 determines that ID data matches (Step S240), it transmits an access enable signal EN to the operation code decoder 204. In this event access will be enabled only to storage device 21 of the storage devices 21, 23, 25, 27 that make up the first group, or, if the ID data is (1, 1, 1), to the memory arrays of all of the storage devices 21, 23, 25, 27. Upon receiving the access enable signal EN, the operation code decoder 204, in sync with the rising edge of the fourth clock signal SCK [pulse] after the reset signal RST has switched from Low to High, acquires the read/write command sent to the data bus, and decides if it is a Write command (Step S240).

If the operation code decoder 204 determines that it is write data (Step S240: Yes) it sends a Write command to the I/O controller 205. Upon receiving the Write command the I/O controller 205 changes the direction of data transfer vis-à-vis the memory cell 201 to the write direction, and cancels the high impedance setting of the signal line connected to the data terminal DT to enable data transfer (Step S250). In this state write data sent to the data bus is stored sequentially one bit at a time in the addresses (locations) in memory array 201 indicated by sequentially counted up counter values in the address counter 202, in sync with the clock signal SCK. Since the storage device 21 pertaining to this embodiment is sequentially accessed, write data sent from the CPU 31 has the same values (0 or 1) as data currently stored in the memory array 201, with the exception of the data corresponding to the desired address to be rewritten. In other words, data for non-rewritable addresses in memory array 201 is overwritten with the same values.

If the operation code decoder 204 has determined that the data is not write data (Step S240: No) it sends a Read command to the I/O controller 205. Upon receiving the Read command the I/O controller 205 changes the direction of data transfer vis-à-vis the memory cell 201 to the read direction, and cancels the high impedance setting of the signal line connected to the data terminal DT to enable data transfer (Step S260). In this state read data is read sequentially from the addresses (locations) in memory array 201 indicated by sequentially incremented counter values in the address counter 202, in sync with the clock signal SCK, and sequentially written over in the first buffer memory of the I/O controller 205.

In other words, only data from the last read out address (data in the address location indicated by CPU 31) is ultimately stored in the second buffer memory of the I/O controller 205. The I/O controller 205 sends the read out data held in the second buffer memory to the data bus DB via the data terminal DT, from where it is transmitted to the CPU 31.

Finally, when a reset low signal is input, the address counter 202, ID comparator 203 and I/O controller 205 are initialized, and the data write or read operation is terminated.

In the identification system pertaining to Embodiment 1 described hereinabove, storage devices 21–28 are divided into two groups, each group being accessed via a first data signal line DL1 and a second data signal line DL2. Thus, even where eight storage devices are provided, as in this embodiment, by assigning four patterns of ID data to the storage devices constituting each group, each individual storage device can be identified in order to write data to it or read data from it. Additionally, since two data signal lines DL1, DL2 are provided, storage devices 21, 23, 25, 27 of the first group and storage devices 22, 24, 26, 28 of the second group can be accessed simultaneously, reducing the time needed for data read and data write operations.

Further, since read or written data is verified in 1-bit units, re-input of the reset low signal is not required to verify data. Additionally, since as noted the reset signal RST is output even in the event of a power interruption, if the power should unexpectedly be interrupted during a data write operation, writing of data that has finished writing at that point in time will terminate normally; and in this embodiment, since data is written in 1-bit units, the problem of data loss of data that has finished writing can be avoided.

Further, during a power interruption the power supply is backed up for a predetermined time interval by the power backup circuit, and during data write operations, writing proceeds beginning with priority write data, namely remaining ink and ink consumption. Thus, where write operations must be performed on a multiplicity of storage devices 21–28, it will be possible to finish writing the priority write data to all of the storage devices. Since additionally it is possible to write simultaneously to storage devices of the first and second groups using the first and second data signal lines DL1, DL2, it will be possible to complete writing of required data to a greater number of storage devices, without the need to increase the capacity of the backup power circuit.

E. Conceptual Outline of Identification System Pertaining to Embodiment 2

Figure 10:
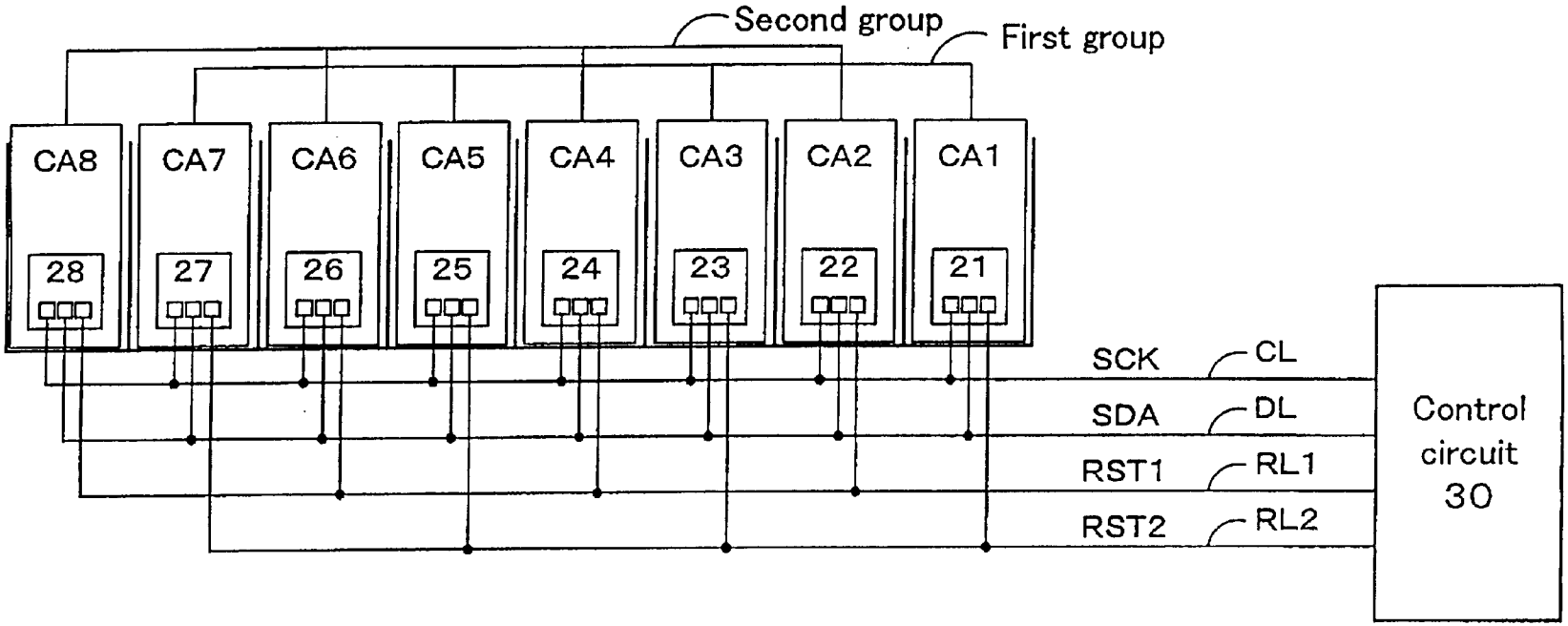
FIG. 10 is an illustrative diagram depicting the features of an identification system pertaining to a second embodiment.

The following conceptual description of the features of an identification system pertaining to Embodiment 2 makes reference to FIG. 10. FIG. 10 is an illustrative diagram depicting the features of an identification system pertaining to a Embodiment 2. Elements identical in function to those in the identification system of Embodiment 1 are assigned the same symbols used in Embodiment 1, and will not be described where to do so would be redundant.

The identification system pertaining to Embodiment 2 features two reset signal lines RL rather than [two] data signal lines DL. Control circuit 30, which controls writing of data to the eight storage devices 21–28 that make up the identification system pertaining to Embodiment 2, as well as reading of data from these storage devices 21–28, transmits a clock signal SCK and a data signal SDA to each of the storage devices 21–28 via a clock signal line CL and data signal line DL. On the one hand, of the reset signals RST transmitted by control circuit 30, a first reset signal RST1 intended for the storage devices 21, 23, 25, 27 of the first group, is supplied via a first reset signal line RDL1 to the storage devices 21, 23, 25, 27 of the first group. A second reset signal RST2 intended for the storage devices 22, 24, 26, 28 of the second group is supplied via a second reset signal line RDL2 to the storage devices 22, 24, 26, 28 of the second group.

Figure 11:
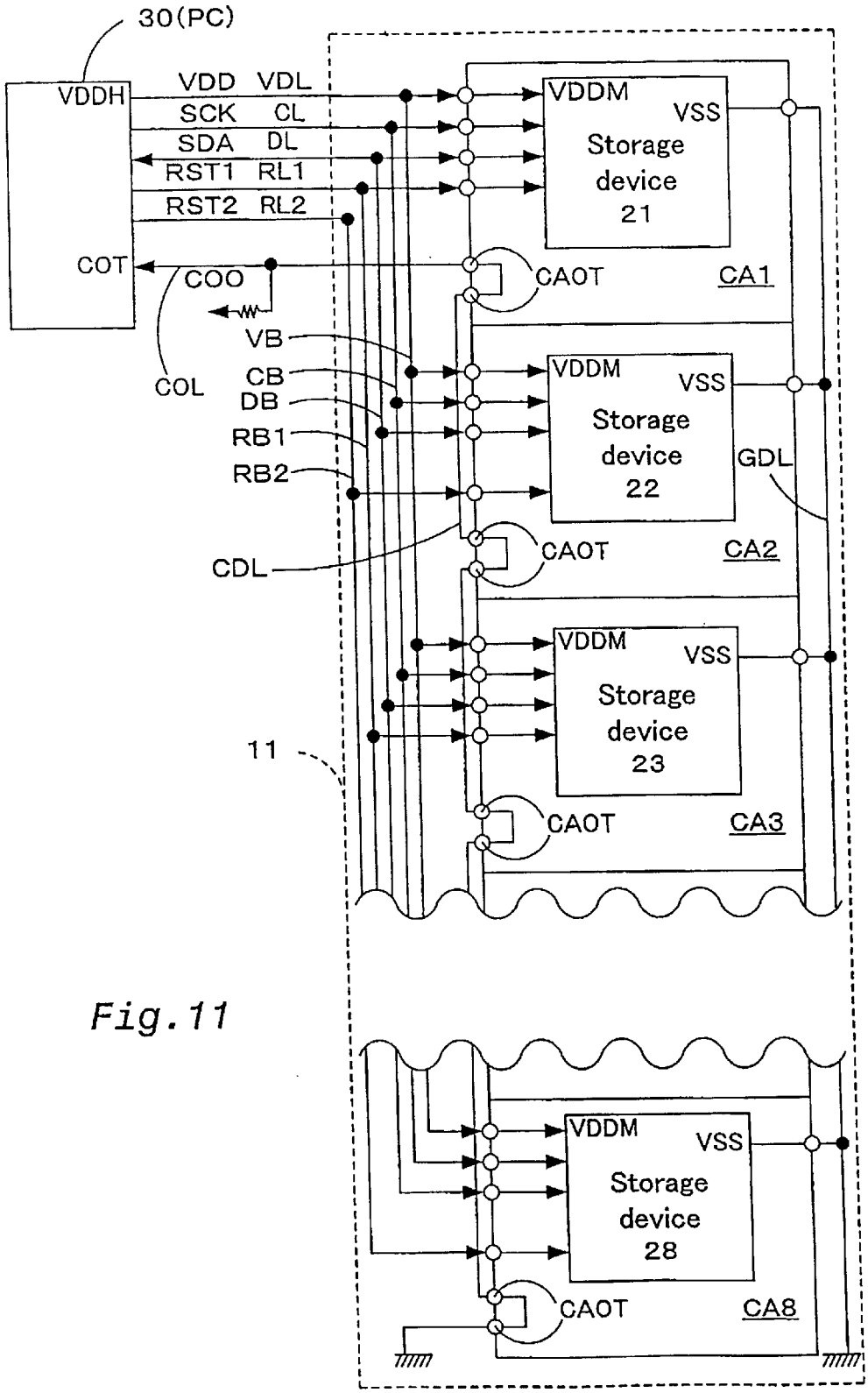
FIG. 11 is a block diagram showing interconnections between a control circuit 30 (personal computer PC) and the storage devices 21–28 of ink cartridges CA1–CA8 in the identification system pertaining to a second embodiment.

The following description of interconnections of the ink cartridge storage devices with control circuit 30 (personal computer PC) makes reference to FIG. 11. FIG. 11 is a block diagram showing interconnections between a control circuit 30 (personal computer PC) and the storage devices 21–28 of ink cartridges CA1–CA8 in the identification system pertaining to Embodiment 2. Elements identical in function to those in the identification system of Embodiment 1 are assigned the same symbols used in Embodiment 1, and will not be described where to do so would be redundant; the following description pertains only to points of difference from Embodiment 1. To facilitate description, in FIG. 11 only the ink cartridges CA1, CA2, CA3, CA8 provided with the storage devices 21, 22, 23, 28 are shown schematically as representative, and in respect of this point the description is similar to that for the identification system pertaining to Embodiment 1.

The data signal terminals DT, clock signal terminals CT, and reset signal terminals RT of the storage devices 21–28 are respectively connected to a data bus DB, a clock bus CB, and a first and second reset bus RB1, RB2. However the storage devices 21, 23, 25, 27 of the first group are connected to first reset bus RB1, and the storage devices 22, 24, 26, 28 of the second group to second reset a bus RB2, respectively. Control circuit 30 is connected to the data bus DB, clock bus CB, and first and second reset buses RB1, RB2 via a data signal line DL, clock signal line CL, and first and second reset signal lines RL1, RL2. Accordingly control circuit 30 is provided with two reset signal generating circuits, one for each of the reset signal lines RL1, RL2, for sending reset signals to the first reset signal line RL1 and second reset signal line RL2. Flexible feed cable (FFC), for example, may be used for signal lines.

F. Operation of Identification System in Embodiment 2

Figure 12:
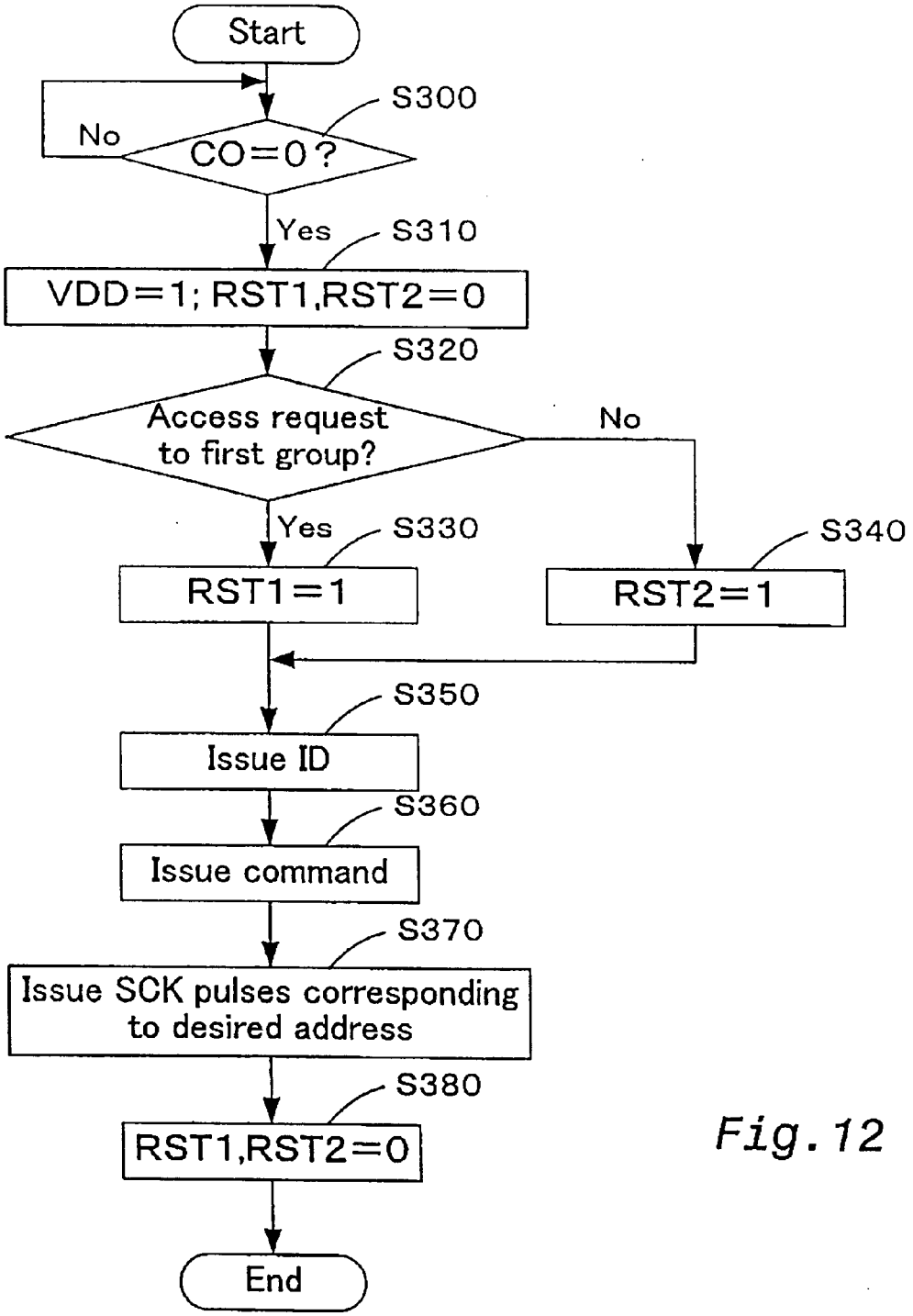
FIG. 12 is a flow chart showing the processing routine executed by control circuit 30 when accessing storage devices 21–28.
Figure 13:
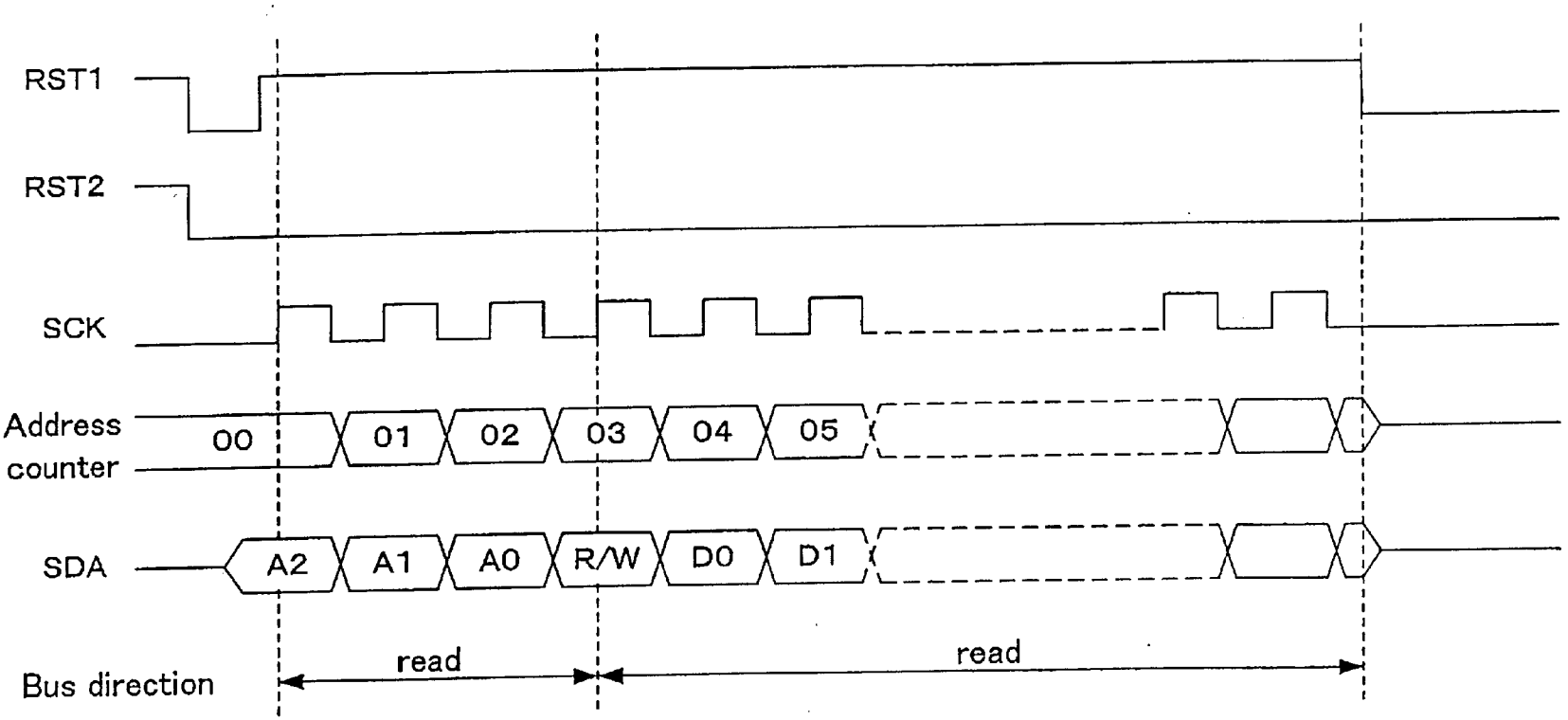
FIG. 13 is a timing chart showing timing relationships of the first and second reset signals RST1, RST2, clock signal SCK, data signal CDA, and address counter value during data read operations from a storage device of the first group.
Figure 14:
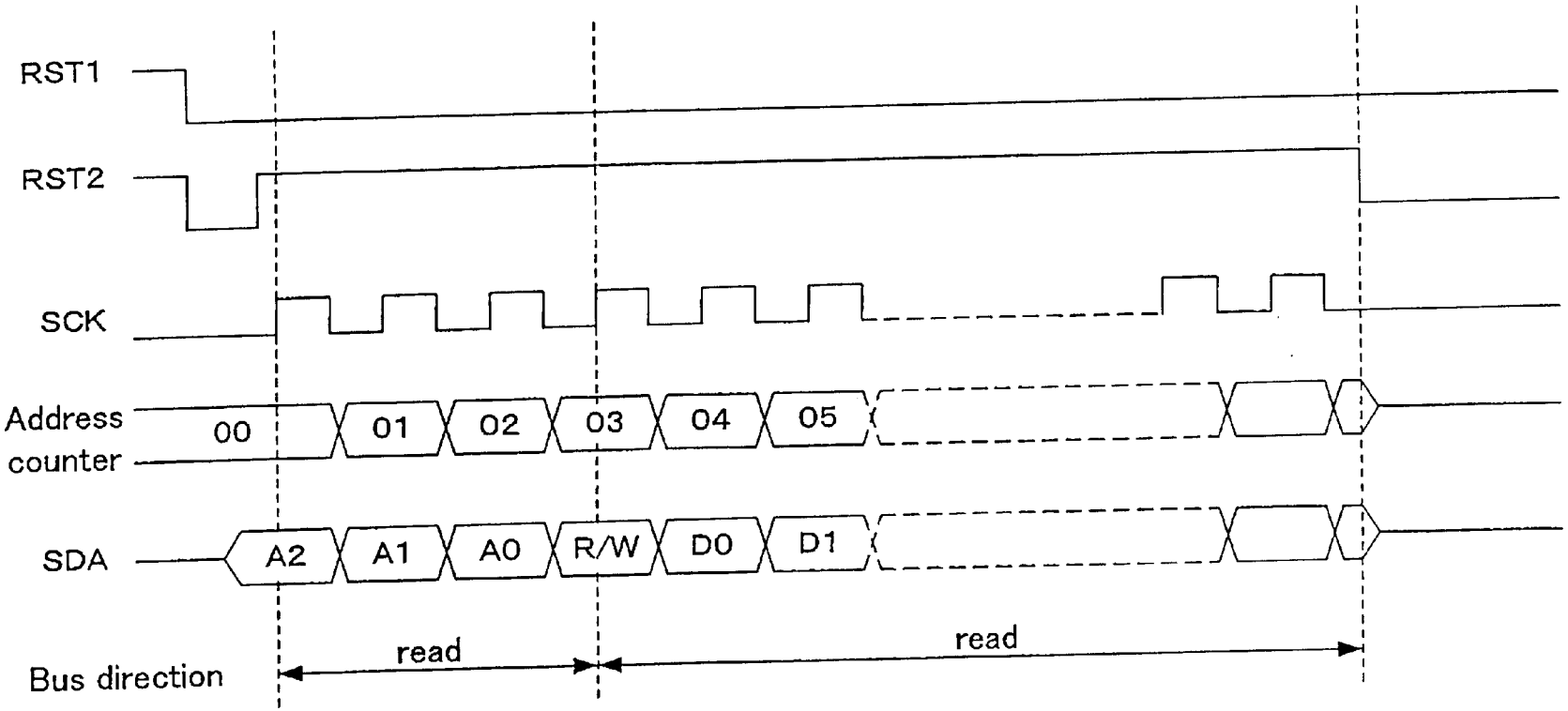
FIG. 14 is a timing chart showing timing relationships of the first and second reset signals RST1, RST2, clock signal SCK, data signal CDA, and address counter value during data read operations from a storage device of the second group.

The following description of operation of the identification system in this embodiment makes reference to FIGS. 12–14. FIG. 12 is a flow chart showing the processing routine executed by control circuit 30 when accessing storage devices 21–28. FIG. 13 is a timing chart showing timing relationships of the first and second reset signals RST1, RST2, clock signal SCK, data signal CDA, and address counter value during data read operations from a storage device of the first group. FIG. 14 is a timing chart showing timing relationships of the first and second reset signals RST1, RST2, clock signal SCK, data signal CDA, and address counter value during data read operations from a storage device of the second group. Steps described previously in Embodiment 1 will here described only briefly.

The CPU 31 of control circuit 30 waits until the input value CO of cartridge out signal line COL goes to 0 (Step S300: No). Once the input value CO of cartridge out signal line COL assumes the value 0 (Step S300: Yes), as shown in FIGS. 13 and 14 CPU 31 supplies power supply voltage (VDD=1) to the positive power terminals VDDM of storage devices 21–28 via power supply line VDL, and causes the first and second reset signal generating circuits to generate reset signals (set RST1, RST2=0) which are transmitted to the first and second reset buses RB1, RB2 via the reset signal lines RL1, RL2 (Step S310). It should be noted that since the reset signal RST is active low, the expression "generate and input a reset signal RST" herein refers to a reset low signal unless indicated otherwise.

CPU 31 decides whether the access request is directed to a storage device 21, 23, 25, 27 of the first group (Step S320). If CPU 31 determines that the access request is directed to a storage device 21, 23, 25, 27 of the first group (Step S320: Yes) it sets the first reset signal generating circuit to RST=1 and sets the first reset signal RST1 to High, as shown in FIG. 13 (Step S330). At this time the second reset signal RST2 is held Low. As noted, enabling of access by control circuit 30 to the storage devices 21=28 in this embodiment is triggered when the reset signal RST goes from Low to High.

Since the storage devices 22, 24, 26, 28 of the second group connected to the second reset signal line RL2 are therefore held at Low signal level, they are floating with respect to the data signal line DL, and will not respond to commands or ID data input from CPU 31. As a result, of storage devices belonging to the first group and storage devices belonging to the second group that contain identical ID data, only those storage devices belonging to the first group will respond to commands from the CPU 31, allowing data to be written to or read from a desired storage device. In this embodiment, the description shall be simplified by describing only the timing chart for data read operations.

If on the other hand CPU 31 determines that the access request is not directed to a storage device 21, 23, 25, 27 of the first group, that is, it is directed to a storage device 22, 24, 26, 28 of the second group (Step S320: No), it sets the second reset signal generating circuit to RST=1 and sets the second reset signal RST2 to High, as shown in FIG. 14 (Step S340). At this time the first reset signal RST1 is held Low.

CPU 31 then issues identifier data (ID data) for the ink cartridge CA1–CA8 (storage devices 21–28) to which access is desired (Step S350). The issued ID data is transferred over the data signal line DL to the data bus DB, in sync with the rising edge of the clock signal SCK [pulse] as shown in FIGS. 13 and 14. In this embodiment, it is sufficient for respective storage devices to be identified within the first group and second group; identification beyond the group level is not required.

CPU 31 issues either a Read command or a Write command to the data signal line DL (Step S360). The issued command is transmitted to the data bus DB via the data signal line DL. The command is transmitted to the data bus DB in sync with the rising edge of the fourth clock signal SCK [pulse] after the first reset signal RST has switched from low to high, as shown in FIGS. 13 and 14 for example.

In this example, as described earlier, where the issued command is a Write command, CPU 31 [requests] the clock signal generating circuit to lower the speed of the clock signal SCK; and where the issued command is a Read command, clock signal speed is maintained.

CPU 31 issues clock signal pulses in a number corresponding to an address (location) in the memory array to be written to or read from, for example, an address in memory array 201 of storage device 21 (Step S370). This is because in this embodiment, storage devices 21–28 are sequentially accessed type storage devices. Finally, CPU 31 causes the first and second reset signal generating circuits to generate reset low signals (set RST1, RST2=0) that are transmitted to the first and second reset buses RB1, RB2 via reset signal lines RL1, RL2, thereby terminating access of storage devices 21–28. Since access is terminated by transmitting a first and second reset signal RST1, RST2 (reset low signals) in this way, and since first and second reset signals RST1, RST2 are transmitted also in the event of a power interruption, the write operation is allowed to terminate normally, at least for data that has finished writing.

According to the identification system pertaining to Embodiment 2 described hereinabove, storage devices 21–28 are divided into first and second groups, and access to the storage devices of either group can be enabled using the first reset signal line RL1 and second reset signal line RL2. Accordingly, even where eight storage devices are provided, as in this embodiment, by assigning four ID data patterns to the storage devices making up each group, each storage device can be identified for reading of data or writing of data. The reset signal generating circuits for generating the first and second reset signals RST1, RST2 have small circuit scale requirements, and thus even if two such reset signal generating circuits are provided, circuit scale will be about the same as with a control circuit 30 provided with a single reset signal generating circuit.

Advantages such as those deriving from verification of read or write data in 1-bit units are analogous to those described for the identification system of Embodiment 1

While the system for identifying printer recording material receptacles herein has been shown and described with reference to certain preferred embodiments, these are simply intended to facilitate understanding of the invention, and imply no limitation thereof. Various modifications and improvements of the invention may be effected without departing from the scope and spirit thereof as set forth in the claims, and these equivalents are naturally included in the invention.

In the preceding embodiments, there were respectively described provision of a single reset signal line RST and two data signal lines DL1, DL2; and two reset signal lines RST1, RST2 and a single data signal line DL. Alternatively it would be possible to provide both two reset signal lines RST1, RST2 and two data signal lines DL1, DL2; or to have more than 2 of each kind of signal line. The advantages of doing so are analogous to those described for Embodiments 1 and 2, with the additional advantage of greater variation in data write/read procedure.

In the preceding embodiments, storage devices 21–28 are described as being EEPROM, but storage devices are not limited to EEPROM, provided that the devices store data in nonvolatile fashion, and allow rewriting of stored data.

In the preceding embodiments, information relating to ink consumption or remaining ink are cited as examples of information assigned priority in writing, but other data could be assigned as write priority information, either instead of or addition to this information.

In the preceding embodiments, identifier data is stored on the leading 3 bits of memory array 201, but the volume of identifier data can be modified as appropriate to the number of storage devices needing to be identified. Memory array 201 capacity is not limited to 256 bits, and may be modified as appropriate to the amount of data needing to be stored.

In the preceding embodiments, the storage devices 21–28 are assigned to independent ink cartridges, but instead the storage device 21 pertaining to the embodiments could be implemented in ink cartridges of 2 to 7 colors, or 9 or more colors. The number of storage devices making up the first and second groups may also be modified as desired, for example, to 4:3 or 1:6. Where a 1:6 arrangement is selected, 1 may be assigned to a group in which are applied a multiplicity of arbitrarily selected ink colors, and 6 assigned to a group in which the same ink color is always applied, for example, dark yellow, or plain paper black (for example, cyan, light cyan, magenta, light magenta or black). In this case it will be possible to the assign the same ID data to arbitrarily used ink colors, simplifying management of ID data. When identifying a multiplicity of ink colors, ink color contained in ink cartridges may be determined using the information of ink color and ink type, stored the storage devices together with ID data.

What is claimed is:

1. A system for identifying printer recording material receptacles wherein a desired selected printer recording material receptacle may be identified from among a multiplicity of printer recording material receptacles comprising sequentially accessible storage devices, wherein said system comprises:

a multiplicity of printer recording material receptacle groups, each of which comprises a multiplicity of printer recording material receptacles;

storage devices, provided to each said printer recording material receptacle, that store different identifying information within each said group;

a multiplicity of data signal lines, said lines bus-connected on a group-bygroup basis to the storage devices of the printer recording material receptacles that make up each said group; and information processing control means that utilizes said identifying information to select one or a multiplicity of desired printer recording material receptacles from among said printer recording material receptacles, and reads or writes information from or to the storage device of one or multiplicity of selected printer recording material receptacles using one or a multiplicity of data signal lines selected from said multiplicity of data signal lines.

2. A system for identifying printer recording material receptacles wherein a desired selected printer recording material receptacle may be identified from among a multiplicity of printer recording material receptacles comprising sequentially accessible storage devices, wherein said system comprises:

a multiplicity of printer recording material receptacles constituting a first group, each receptacle comprising a storage device that stores different identifying information;

a multiplicity of printer recording material receptacles constituting a second group, different from the printer recording material receptacles constituting said first group, each receptacle comprising a storage device that stores different identifying information;

a first data signal line, said line being bus-connected to the storage devices of the printer recording material receptacles constituting said first group;

a second data signal line, said line being bus-connected to the storage devices of the printer recording material receptacles constituting said second group; and information processing control means that utilizes said identifying information to select one or a multiplicity of desired printer recording material receptacles from among said printer recording material receptacles, and that reads or writes information from or to the storage device of one or multiplicity of selected printer recording material receptacles using said first data signal line and/or said second data signal line.

3. A system for identifying printer recording material receptacles according to claim 2 further comprising:

a clock signal line connected to the printer recording material receptacles that constitute said first and second groups;

wherein said information processing control means is configured such that a data sequence containing a read/write instruction and identifying information corresponding to the storage device of said selected printer recording material receptacle is transmitted over said first data signal line and/or said second data signal line in sync with a clock signal flowing over said clock signal line, to execute reading/writing of information to the storage device of said one or multiplicity of selected printer recording material receptacles.

4. A system for identifying printer recording material receptacles according to claim 3 wherein the storage device of said one or multiplicity of selected printer recording material receptacles is configured such that on the basis of said transmitted read/write instruction, it either transmits stored information over said first data signal line and/or said second data signal line, or stores information present on said first data signal line and/or said second data signal line.

5. A system for identifying printer recording material receptacles wherein a desired selected printer recording material receptacle may be identified from among a multiplicity of printer recording material receptacles comprising sequentially accessible storage devices, wherein said system comprises:

a multiplicity of printer recording material receptacles constituting a first class, each receptacle comprising a storage device that stores different identifying information;

a single printer recording material receptacle constituting a second class, the receptacle comprising a storage device that stores identifying information identical to any identifying information stored in the storage devices constituting said first class, or identifying information different from all identifying information stored in the storage devices constituting said first class;

a first data signal line, said line being bus-connected to the storage devices of the printer recording material receptacles constituting said first class;

a second data signal line, said line being bus-connected to the storage devices of the printer recording material receptacles constituting said second class; and information processing control means that utilizes said identifying information to select one or a multiplicity of desired printer recording material receptacles from among said printer recording material receptacles, and reads or writes information from or to the storage device of one or multiplicity of selected printer recording material receptacles using said first data signal line and/or said second data signal line.

6. A system for identifying printer recording material receptacles according to claim 5 wherein the storage device of the printer recording material receptacle constituting the second class may store the same given identifying information regardless of the printer recording material contained; and said storage device may further store, in addition to said identifying information, color information for the printer recording material contained in said printer recording material receptacle.

7. A system for identifying printer recording material receptacles according to claim 6 wherein said first class is composed of from 4 to 6 printer recording material receptacles.

8. A system for identifying printer recording material receptacles wherein a desired selected printer recording material receptacle is identified from among a multiplicity of printer recording material receptacles comprising sequentially accessible storage devices, and wherein reading/writing of information from or to the storage device of the selected printer recording material receptacle is performed, wherein said system comprises:

a multiplicity of printer recording material receptacles constituting a first group, each receptacle comprising a storage device that stores different identifying information;

a multiplicity of printer recording material receptacles constituting a second group, different from the printer recording material receptacles constituting said first group, each receptacle comprising a storage device that stores different identifying information, said storage devices;

a data signal line, said line being bus-connected to the printer recording material receptacles constituting said first and second groups;

a first reset signal line connected to the storage devices of the printer recording material receptacles constituting said first group;

a second reset signal line connected to the storage devices of the printer recording material receptacles constituting said second group; and information processing control means that holds said first reset signal line or said second reset signal line in the reset state, selects a desired storage device from said storage devices using said identifying information, and that performs reading/writing of identifying information via said data signal line.

9. A system for identifying printer recording material receptacles according to claim 8 further comprising:

a clock signal line connected to the printer recording material receptacles that constitute said first and second groups;

wherein said information processing control means is configured such that, when a printer recording material receptacle of said first group is selected, said second reset signal line is held in the reset state, and a data sequence containing a read/write instruction and identifying information corresponding to the storage device of the selected printer recording material receptacle is transmitted over said data signal line in sync with a clock signal flowing over said clock signal line, to execute reading/writing of information to the storage device of said selected printer recording material receptacle.

10. A system for identifying printer recording material receptacles according to claim 8 further comprising:

a clock signal line connected to the printer recording material receptacles that constitute said first and second groups;

wherein said information processing control means is configured such that, when a printer recording material receptacle of said second group is selected, said first reset signal line is held in the reset state, and a data sequence containing a read/write instruction and identifying information corresponding to the storage device of the selected printer recording material receptacle is transmitted over said data signal line in sync with a clock signal flowing over said clock signal line, to execute reading/writing of information to the storage device of said selected printer recording material receptacle.

11. A system for identifying printer recording material receptacles according to any of claims 1 to 10 wherein each said storage device comprises:

a memory cell for storing data;

a data bus connected to said data signal line;

an address counter that counts up a counter value in sync with a clock signal input via said clock signal line, indicating a memory area of said memory cell to be accessed, and that when initialized resets the counter to an initial value;

an input/output control device, arranged between said memory cell and said data bus, that controls the direction of data transfer vis-a-vis said memory cell and the direction of data transfer over said data bus, and that when initialized sets the direction of data transfer vis-a-vis said memory cell to the data read direction, and disables connection to said data bus;

a comparator device connected to said data bus, that decides whether input identifying information input via said data bus matches identifying information stored in said memory cell read via said input/output control device; and an access enabling device that enables access to said memory cell when it has been decided that said identifying information matches.

12. A system for identifying printer recording material receptacles according to claim 11 wherein said storage device additionally comprises:

an instruction decoder connected to said data bus and to said comparator device, that, upon being presented by said comparator device with a decision result that said input identifying information matches identifying information stored in said memory cell, analyzes the read/write command input via said data bus, and on the basis of the result of the analysis requests said input/output control device to switch the direction of data transfer over said data bus;

and wherein said input/output control device maintains the data transfer direction vis-a-vis said memory cell and the disabled connection to said data bus set during said initialization, until analysis of the read/write command by said instruction decoder is completed.

13. A system for identifying printer recording material receptacles according to any of claims 1 to 10 wherein said storage devices store different identifying information for each ink type in association with the ink types contained in said printer recording material receptacles.

14. A system for identifying printer recording material receptacles according to claim 13 wherein said information processing control means comprises:

a clock signal generating circuit;

a reset signal generating circuit that generates a reset signal for initializing said storage devices;

an identifying information generating circuit that generates identifying information serving as identifying information for a particular storage device from among said multiplicity of storage devices; and a data transmission circuit that in sync with said generated clock signal transmits a data sequence containing said generated identifying information and a read/write command over a said data signal line.

15. A printer recording material receptacle set composed of a multiplicity of printer recording material receptacles, said receptacles comprising sequentially accessible storage devices that at a minimum store information relating to printer recording materials encapsulated therein, wherein said receptacle set comprises:

a multiplicity of printer recording material receptacles each having a storage device bus-connected to a clock signal line that supplies a clock signal, a reset signal line that supplies a reset signal, a first data signal line, and storing different identifying information, said receptacles constituting a first printer recording material receptacle group; and a multiplicity of printer recording material receptacles each having a storage device bus-connected to said clock signal line, to said reset signal line, to a second data signal line, and storing different identifying information, said receptacles constituting second printer recording material receptacle group.

16. A printer recording material receptacle set composed of a multiplicity of printer recording material receptacles, said receptacles comprising sequentially accessible storage devices that at a minimum store information relating to printer recording materials encapsulated therein, wherein said receptacle set comprises:

a multiplicity of printer recording material receptacle groups including a multiplicity of printer recording material receptacles, wherein each printer recording material receptacle is bus-connected to a clock signal line that supplies a clock signal, a single reset signal line that supplies a reset signal, and a multiplicity of data signal lines, and stores different identifying information.

17. A printer recording material receptacle set composed of a multiplicity of printer recording material receptacles, said receptacles comprising sequentially accessible storage devices that at a minimum store information relating to printer recording materials encapsulated therein, wherein said receptacle set comprises:

a multiplicity of printer recording material receptacle groups including a plurality of printer recording material receptacles, wherein each printer recording material receptacle having a storage device that is bus-connected to a clock signal line that supplies a clock signal, a multiplicity of reset signal lines that supply a reset signal, a multiplicity of data signal lines, and stores different identifying information.

18. A printer recording material receptacle set composed of a multiplicity of printer recording material receptacles, said receptacles comprising sequentially accessible storage devices that at a minimum store information relating to printer recording materials encapsulated therein, wherein said receptacle set comprises:

a multiplicity of printer recording material receptacle groups including a plurality of printer recording material receptacles, wherein each printer recording material receptacle having a storage device that is bus-connected to a clock signal line that supplies a clock signal, one or a multiplicity of reset signal lines that supply a reset signal, multiplicity of data signal lines, and stores different identifying information.

19. A printer recording material receptacle set composed of a multiplicity of printer recording material receptacles, said receptacles comprising sequentially accessible storage devices that at a minimum store information relating to printer recording materials encapsulated therein, wherein said receptacle set comprises:

a multiplicity of printer recording material receptacles each having a storage device that is bus-connected to a clock signal line that supplies a clock signal, a data signal line that transmits a data signal, and a first reset signal line that supplies a first reset signal, and stores different identifying information, and wherein said receptacles constitute a first printer recording material receptacle group; and a single printer recording material receptacle having a storage device that is bus-connected connected to said clock signal line, said data signal line, and a second reset signal line that supplies a second reset signal, and stores different identifying information, and wherein said receptacle constitutes a second printer recording material receptacle group.

20. A printer recording material receptacle set according to any of claims 15 to 19 wherein identifying information stored in a storage device of said first printer recording material receptacle group is identical to identifying information stored in a storage device of the second printer recording material receptacle group.

21. A method for identifying a printer recording material receptacle to which access is desired from among a first printer recording material receptacle group comprising a multiplicity of nonvolatile, sequentially accessible storage devices bus-connected to a clock signal line, a reset signal line and a first data signal line, and having unique identifying information, and a second printer recording material receptacle group comprising a multiplicity of nonvolatile, sequentially accessible storage devices bus-connected to a clock signal line, a reset signal line and a second data signal line, and having unique identifying information, wherein said method comprises the steps of:

outputting a reset signal to said reset signal line; and transmitting a data sequence over said first data signal line and/or said second data signal line in sync with the clock signal, said data sequence including a read/write instruction and identifying information for the storage device of said printer recording material receptacle printer recording material receptacle to which access is desired.

22. A method for identifying a printer recording material receptacle to which access is desired from among a first printer recording material receptacle group comprising a multiplicity of nonvolatile, sequentially accessible storage devices bus-connected to a clock signal line, a data signal line and a first reset signal line, and having unique identifying information, and a second printer recording material receptacle group comprising a multiplicity of nonvolatile, sequentially accessible storage devices bus-connected to a clock signal line, a data signal line, and a second reset signal line, and having unique identifying information, wherein said method comprises the steps of:

transmitting a reset signal to said first reset signal line and said second reset signal line on the basis of an access request to said printer recording material receptacle;

deciding if the printer recording material receptacle to which access has been requested belongs to said first group or said second group;

in the event it is decided that said printer recording material receptacle to which access has been requested belongs to said first group, halting transmission of the reset signal to said first reset signal line; and transmitting to said data signal line, in sync with the clock signal, a data sequence that includes a read/write instruction and identifying information for the storage device of said printer recording material receptacle printer recording material receptacle to which access has been requested.

23. A method according to claim 22 wherein in the event it is decided that said printer recording material receptacle to which access has been request-ed belongs to said second group, transmission of the reset signal to said second reset signal line is halted; and a data sequence that includes a read/write instruction and identifying information for the storage device of said printer recording material receptacle printer recording material receptacle to which access has been requested is transmitting to said data signal line, in sync with the clock signal.

* * * * *